US012479682B2

(12) United States Patent
Yamada et al.

(10) Patent No.: US 12,479,682 B2
(45) Date of Patent: Nov. 25, 2025

(54) SHEET FEEDING APPARATUS

(71) Applicant: CANON KABUSHIKI KAISHA, Tokyo (JP)

(72) Inventors: Kaname Yamada, Chiba (JP); Takayuki Fukushima, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 273 days.

(21) Appl. No.: 18/323,634

(22) Filed: May 25, 2023

(65) Prior Publication Data

US 2023/0391570 A1 Dec. 7, 2023

(30) Foreign Application Priority Data

Jun. 6, 2022 (JP) ..... 2022-091741

(51) Int. Cl.
*B65H 7/02* (2006.01)
*B65H 3/06* (2006.01)
*B65H 5/06* (2006.01)

(52) U.S. Cl.
CPC ..... *B65H 7/02* (2013.01); *B65H 3/0669* (2013.01); *B65H 5/062* (2013.01)

(58) Field of Classification Search
CPC ..... B65H 7/02; B65H 3/0669; B65H 5/062
See application file for complete search history.

(56) References Cited

U.S. PATENT DOCUMENTS 5,209,465 A * 5/1993 Sayama ..... B65H 3/0669 271/118
11,554,928 B2 * 1/2023 Yamada ..... B65H 3/565
2018/0239291 A1 * 8/2018 Tanaka ..... B65H 7/16
2021/0122596 A1 * 4/2021 Yamada ..... B65H 3/0684
2021/0188581 A1 * 6/2021 Niwata ..... B65H 3/0661

FOREIGN PATENT DOCUMENTS

JP H05147755 A 6/1993

* cited by examiner

*Primary Examiner* — Thomas A Morrison
(74) *Attorney, Agent, or Firm* — ROSSI, KIMMS & McDOWELL LLP

(57) ABSTRACT

A sheet feeding apparatus includes a supporting unit, a sheet feeding unit, a separation unit, a moving member, a first sensor, and a control unit. The moving member is configured to move by being pushed by the sheet supported by the supporting unit. The first sensor is configured to detect the sheet based on a position of the moving member. The second sensor is configured to detect the sheet at a position downstream of the separation unit in the feeding direction. The control unit is configured to determine an existence of the sheet supported by the supporting unit based on a detection result of the first sensor, and to control feeding timing at which the sheet feeding unit starts to feed the sheet based on detection results of the first sensor and the second sensor.

14 Claims, 16 Drawing Sheets

SHEET FEEDING APPARATUS

BACKGROUND OF THE INVENTION

Field of the Invention

The present invention relates to a sheet feeding apparatus for feeding sheets.

Description of the Related Art

Hitherto, Japanese Patent Laid-Open No. H05-147755 proposes a sheet feeding apparatus that includes a sheet placement sensor that detects whether a stack of sheets is placed on a sheet feeding platen, and a sheet leading-edge position sensor that detects whether the leading edge of the sheet stack is in the vicinity of a pressure contact portion between a sheet feeding roller and a separation pad. In the sheet feeding apparatus, a calling roller is provided upstream in a feeding direction of the sheet feeding roller, and when the sheet placement sensor is turned ON, the calling roller conveys the sheet until the leading edge of the sheet reaches the detection position of the sheet leading-edge position sensor. As a result, the position of the leading edge of the sheet is aligned regardless of the placement position of the sheet, and preparations for sheet feeding are complete.

However, the sheet feeding apparatus disclosed in Japanese Patent Laid-Open No. H05-147755 is provided with two sensors, namely a sheet placement sensor and a sheet leading-edge position sensor in order to detect the presence or absence of a sheet on a sheet feeding platen and the position of the leading edge of the sheet. For this reason, the space for sensor placement is increased, thereby increasing the size of the apparatus and increasing the number of parts, leading to higher costs.

Furthermore, recent years have witnessed a demand for enhanced productivity of sheet feeding apparatuses by shortening a sheet interval, which is the distance between a preceding sheet and a succeeding sheet.

Therefore, an object of the present invention is to provide a sheet feeding apparatus that enables a more compact and lower-cost apparatus while improving productivity.

SUMMARY OF THE INVENTION

According to a first aspect of the present invention, a sheet feeding apparatus, comprising a supporting unit configured to support a sheet, a sheet feeding unit configured to feed the sheet supported by the supporting unit in a feeding direction, a separation unit configured to separate sheets fed by the sheet feeding unit one by one, a moving member configured to move by being pushed by the sheet supported by the supporting unit, a first sensor configured to detect the sheet based on a position of the moving member, a second sensor configured to detect the sheet at a position downstream of the separation unit in the feeding direction, a control unit configured to determine an existence of the sheet supported by the supporting unit based on a detection result of the first sensor, and to control feeding timing at which the sheet feeding unit starts to feed the sheet based on detection results of the first sensor and the second sensor.

Further features of the present invention will become apparent from the following description of exemplary embodiments with reference to the attached drawings.

DESCRIPTION OF THE EMBODIMENTS

First Embodiment

Hereinafter, a sheet feeding apparatus, an image reading apparatus, and an image forming apparatus according to the present disclosure will be described with reference to the drawings. The dimensions, materials, shapes, relative arrangements, and the like of the constituent elements described in the following embodiments are not intended to particularly limit the scope of application of the present technology only to such dimensions, materials, shapes, relative arrangements, and the like, unless otherwise specified.

Schematic Configuration of Image Forming Apparatus

Figure 1:
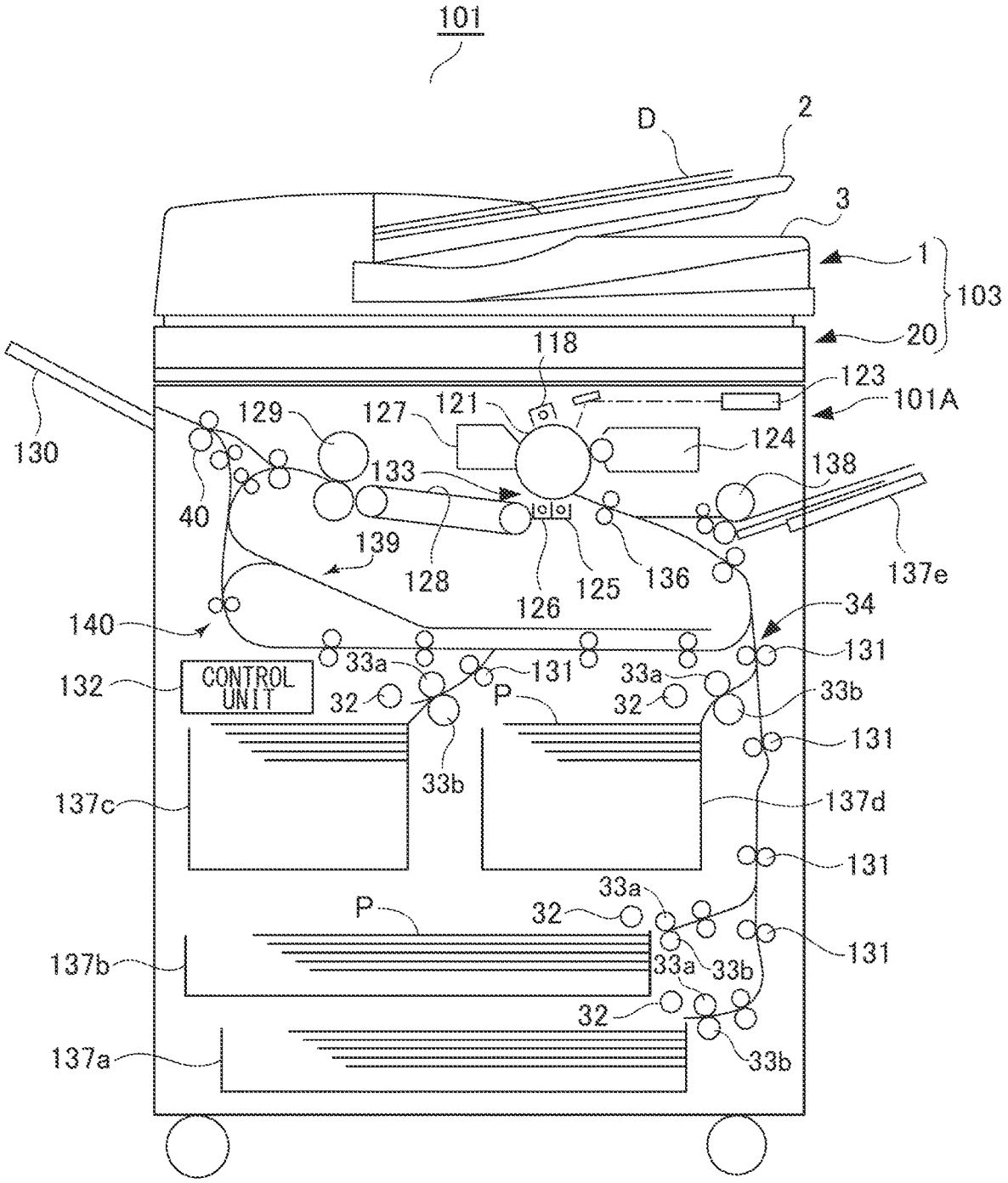
FIG. 1 is an overall schematic diagram illustrating an image forming apparatus according to a first embodiment.

First, a schematic configuration of an image forming apparatus 101 will be described with reference to FIG. 1. As illustrated in FIG. 1, the image forming apparatus 101 includes a printer body 101A and an image reading apparatus 103. The image reading apparatus 103 disposed above the printer body 101A includes a reader 20 and an auto document feeder (ADF) 1, as will be described in detail below, and optically scans a document to read image information. The document is paper such a sheet or an envelope, a plastic film such as a sheet for an overhead projector (OHP), or a sheet of cloth or the like. The image information, which is converted into an electric signal by the image reading apparatus 103, is transferred to a control unit 132 provided to the printer body 101A.

The printer body 101A has an image forming unit 133 capable of forming an image on a sheet P serving as a recording medium, and a sheet feeding unit 34 that feeds the sheet P to the image forming unit 133. The sheet feeding unit 34 includes sheet storage portions 137*a*, 137*b*, 137*c*, and 137*d* capable of storing sheets of mutually different sizes. The sheets stored in each sheet storage portion are fed out by a pickup roller 32, separated one by one by a feed roller 33*a* and a retard roller 33*b*, and delivered to a corresponding conveyance roller pair 131. The sheet P is sequentially delivered to a plurality of conveyance roller pairs 131 arranged along the sheet conveyance path and is thus conveyed to a registration roller pair 136.

Note that the sheet P placed by the user in a manual feed tray 137*e* is fed into the printer body 101A by a feed roller 138 and conveyed to the registration roller pair 136. The registration roller pair 136 stops the leading edge of the sheet P to correct skew feeding, and resumes conveyance of the sheet Pin accordance with the progress of an image forming operation which is a process in which a toner image is formed using the image forming unit 133.

The image forming unit 133 that forms an image on the sheet P is an electrophotographic-type image forming unit that includes a photosensitive drum 121 that is a photosensitive member. The photosensitive drum 121 is rotatable along the direction in which the sheet P is conveyed, and an electrostatic charging unit 118, an exposing unit 123, a developing unit 124, a transfer electrostatic charging unit 125, a separation electrostatic charging unit 126, and a cleaner 127 are arranged around the photosensitive drum 121. The electrostatic charging unit 118 uniformly charges the surface of the photosensitive drum 121, and the exposing unit 123 exposes the photosensitive drum 121 based on image information that is inputted from the image reading apparatus 103 or the like, and forms an electrostatic latent image on the drum.

The developing unit 124 stores a two-component developer containing a toner and a carrier, and develops an electrostatic latent image into a toner image by supplying charged toner to the photosensitive drum 121. The toner image borne by the photosensitive drum 121 is transferred to the sheet P conveyed from the registration roller pair 136 by a bias electric field formed by the transfer electrostatic charging unit 125. The sheet P, which serves as a recording medium to which the toner image is transferred, is spaced apart from the photosensitive drum 121 by the bias electric field formed by the separation electrostatic charging unit, and is conveyed toward a fixing unit 129 by a pre-fixing conveyance unit 128. Note that an adhesive substance such as transfer residual toner remaining on the photosensitive drum 121 without being transferred to the sheet P is removed by the cleaner 127, and the photosensitive drum 121 is prepared for the next image forming operation.

The sheet P conveyed to the fixing unit 129 is nipped in the roller pair and heated while being pressurized, and the image is fixed by melting and fixing of the toner. In a case where the image output is complete, the sheet P whereon the fixed image was obtained is discharged to a sheet discharge tray 130 that protrudes outward from the printer body 101A via a sheet discharge roller pair 40. In a case where an image is formed on the back surface of the sheet Pin duplex printing, the front surface and the back surface of the sheet P, which has passed through the fixing unit 129, are switched by a reverse conveyance unit 139, and the sheet P is conveyed to the registration roller pair 136 by a duplex conveyance unit 140. The sheet P whereon the image is again formed by the image forming unit 133 is discharged to the sheet discharge tray 130.

Image Reading Apparatus

Figure 2:
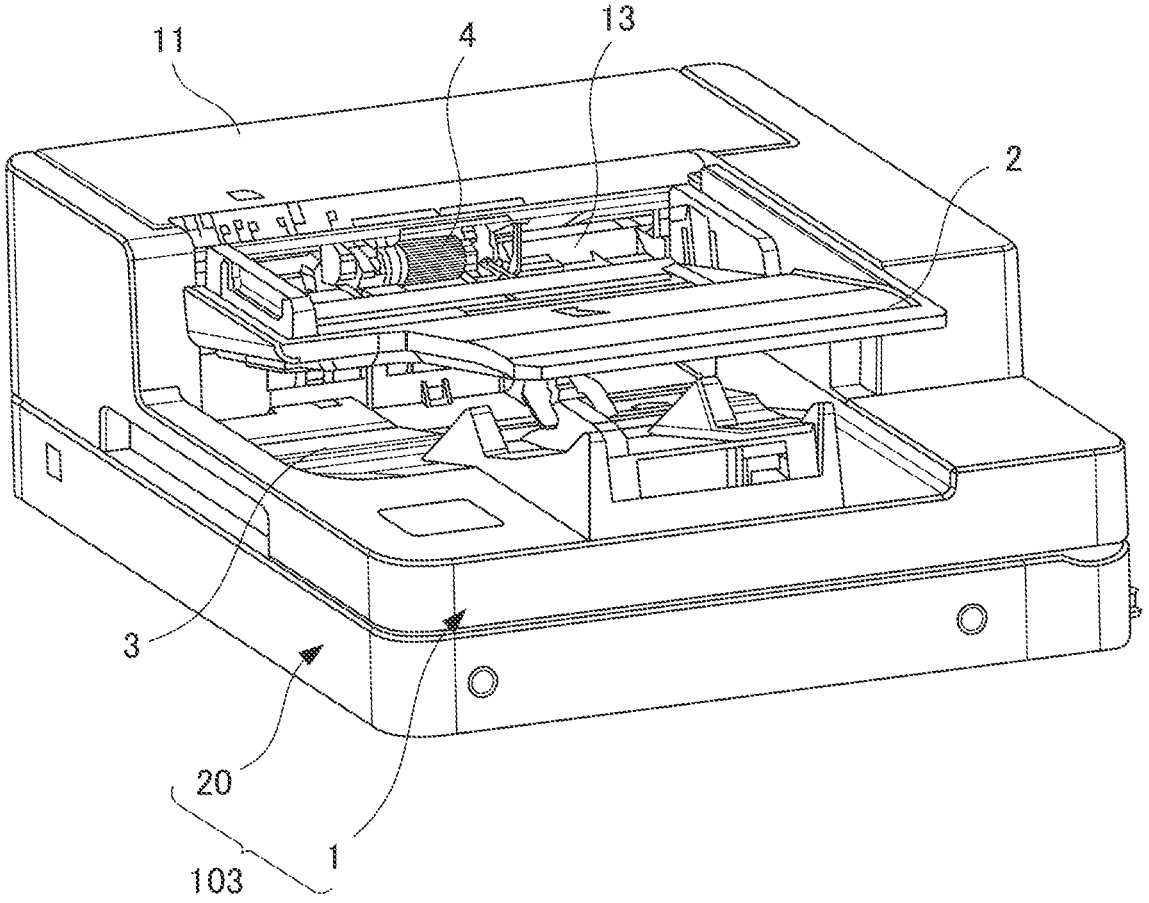
FIG. 2 is a perspective view illustrating an image reading apparatus.

Next, a configuration of the image reading apparatus 103 will be described with reference to FIGS. 2 and 3. As illustrated in FIG. 2, the image reading apparatus 103 includes a reader 20, which serves as a reading unit for reading documents, and an ADF 1, which serves as a sheet feeding apparatus. The ADF 1 includes a conveyance unit 13, a cover 11 that is openably/closably supported by the conveyance unit 13, a document tray 2 serving as a supporting unit into which documents are loaded or supported, and a sheet discharge tray 3. That is, the cover 11 is supported by the conveyance unit 13 and configured to open/close the conveyance unit 13.

Figure 3:
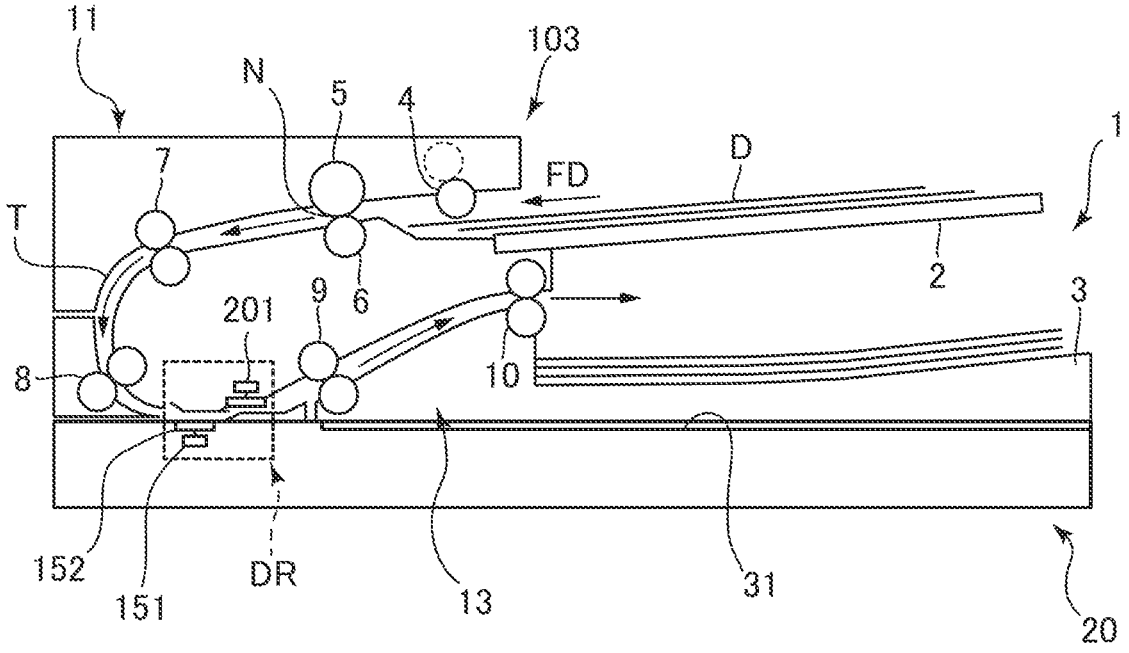
FIG. 3 is a cross-sectional view illustrating the image reading apparatus.

As illustrated in FIG. 3, the image reading apparatus 103 includes a first reading unit 151 disposed in the reader 20 and a second reading unit 201 disposed in the ADF 1. Hereinafter, each element constituting the image reading apparatus 103 will be described.

The first reading unit 151 is an example of a first reading unit for reading image information from a first surface of the document D. The second reading unit 201 is an example of a second reading unit for reading an image of a second surface on the side of the document D opposite to the first surface. The first surface according to the present embodiment is the lower surface of the document D in the duplex reading unit DR, and the second surface is the upper surface of the document D in the duplex reading unit DR. The first reading unit 151 and the second reading unit 201 constitute a duplex reading unit DR that is capable of simultaneously reading both sides of the document D conveyed by the ADF 1. However, the duplex reading unit DR does not always execute simultaneous reading of both sides, and is also capable of reading only one side.

The first reading unit 151 and the second reading unit 201 include a contact image sensor (hereinafter referred to as the CIS) which is a scanning apparatus of an equal-magnification optical system. The first reading unit 151 and the second reading unit 201 each include a light source formed of an LED array arranged in a main scanning direction orthogonal to the direction in which document D is conveyed, and a plurality of light-receiving elements similarly arranged in the main scanning direction. Reflected light emitted from the LED array and reflected by the document D forms an image on each light-receiving element via a lens, and is photoelectrically converted by the light-receiving elements.

The reader 20 is fixed to the upper surface of the printer body 101A (see FIG. 1). As illustrated in FIG. 3, a flatbed-type document platen 31 is disposed on the upper surface of the reader 20. The first reading unit 151 is supported by a carriage (not illustrated) that is capable of moving in a left-right direction in the drawing, and is capable of moving along the document platen 31 over the entire length of the document platen 31 from a predetermined position (the illustrated position) in the duplex reading unit DR.

The ADF 1 is supported so as to be openable and closable in an up-down direction with respect to the reader 20 by a hinge mechanism (not illustrated) disposed toward the back of the drawing. The document tray 2 of the ADF 1 supports document D, which is placed by the user. The ADF 1 has a document conveyance path T formed therein, and conveys the document D placed in the document tray 2 to the duplex reading unit DR via the document conveyance path T. Note that part of the document conveyance path T is opened when the cover 11 is opened with respect to the conveyance unit 13, and enables jamming processing to be performed, for example.

Next, a configuration of the ADF 1 for conveying the document D will be described in detail. The ADF 1 has a pickup roller 4, a conveyance roller 5, a separation roller 6, a registration roller pair 7, conveyance roller pairs 8 and 9, and a sheet discharge roller pair 10, in that order along the direction (indicated by an arrow in the drawing) in which a document is conveyed. The pickup roller 4, which serves as a sheet feeding unit, is movable in an up-down direction with respect to the upper surface of the document tray 2, and makes contact with document D on the document tray 2 so as to feed the document D in the feeding direction FD. The conveyance roller 5 conveys the document D received from the pickup roller 4, downstream in the feeding direction FD. The separation roller 6 makes pressure contact with the conveyance roller 5 to form a separation nip N, which serves as a separation unit between the separation roller 6 and the conveyance roller 5, and separates the documents D conveyed by the conveyance roller 5 one by one. Note that, according to the present embodiment, the separation nip N is formed by the conveyance roller 5 and the separation roller 6, but the present invention is not limited thereto. For example, instead of the separation roller 6, a retard roller to which reverse rotation drive is inputted via a torque limiter, a separation pad, or the like, may be applied.

Note that a feed shaft, which is the rotation shaft of the conveyance roller 5, is rotatably supported by the cover 11, and the pickup roller 4 is swingably supported with respect to the feed shaft via a pickup arm (not illustrated). One roller of the registration roller pair 7 is also rotatably supported by the cover 11.

The registration roller pair 7 receives the downstream end in the direction in which document D is conveyed (hereinafter, referred to as the leading edge) by the conveyance roller 5 in a state where the rotation is stopped, and deflects the document D to correct skew feeding. Further, the registration roller pair 7 conveys the document D, for which the skew feeding has been corrected, via the bent portion of the document conveyance path T and delivers the document D to the conveyance roller pair 8. The conveyance roller pair 8 feeds the document D into the duplex reading unit DR and delivers the document D to the conveyance roller pair 9 on the downstream side. At this time, the image of document D is read by the first reading unit 151 and the second reading unit 201. The conveyance roller pair 9 delivers the document D, which has passed through the duplex reading unit DR, to the sheet discharge roller pair 10. The sheet discharge roller pair 10 discharges the document D to a document discharge unit 3.

The image reading apparatus 103 configured as described above reads image information from the document D using a feeding-reading mode, in which a document image is scanned while the document D is fed by the ADF 1, and a fixed-reading mode, in which a document placed on the document platen 31 is scanned. The feeding-reading mode is selected in a case where the apparatus detects the document D placed in the document tray 2 or in a case where the user explicitly issues an instruction via an operation panel or the like of the printer body 101A. In this case, the ADF 1 feeds the documents D one by one toward the duplex reading unit DR in a state where the first reading unit 151 is in a predetermined position of the duplex reading unit DR. Further, both the first reading unit and the second reading unit perform scanning by irradiating the document D with scanning light in the case of duplex simultaneous reading, and, in the case of simplex reading, either the first reading unit 151 or the second reading unit 201 performs scanning by irradiating the document D with scanning light. The image information, which is converted into an electric signal by the light-receiving elements, is transferred to the control unit 132 of the printer body 101A.

The fixed-reading mode, on the other hand, is selected in a case where the apparatus detects the document D placed on the document platen 31 or in a case where the user explicitly issues an instruction via the operation panel or the like of the printer body 101A. In this case, the first reading unit 151 scans the document D placed on the document platen 31 by irradiating the document D with light while moving along the document platen 31. The image information, which is converted into an electric signal by the light-receiving elements of the first reading unit 151, is then transferred to the control unit 132 of the printer body 101A.

Figure 4:
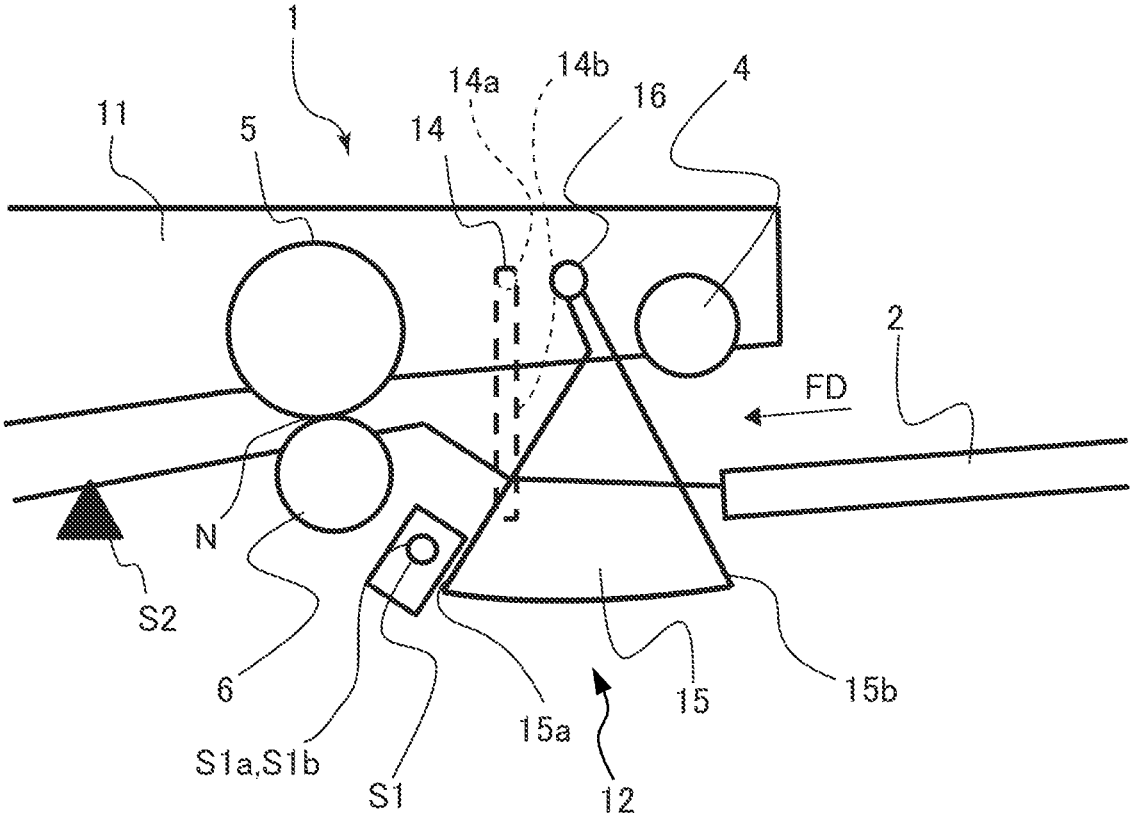
FIG. 4 is a view illustrating an ADF (Auto Document Feeder).

Next, a configuration of the ADF 1 for feeding the document D will be described in more detail with reference to FIG. 4. As illustrated in FIG. 4, the ADF 1 has a document stopper 14, a flag 12, a first sensor S1, and a second sensor S2. The document stopper 14, which serves as an abutment member, is rotatably supported by the cover 11 about a rotation shaft 14*a*. The document stopper 14 is configured to move between an abutment position and a moving position by being pushed by the document. The document stopper 14 can be switched between a locked state and an unlocked state in conjunction with a lifting operation of the pickup roller 4 and the pickup arm (not illustrated).

That is, when the pickup arm rotates, the pickup roller 4 is capable of moving to a standby position spaced apart from the document D loaded in the document tray 2, and a feeding position in which the pickup roller 4 makes contact with the document D loaded in the document tray 2 in which the document D can be fed. Further, when the pickup roller 4 is located in the standby position, the document stopper 14 enters a locked state of being locked in an abutment position, which is illustrated in FIG. 4. Further, when the pickup roller 4 is located in a feeding position, the document stopper 14 is pushed by, for example, the document D and thus enters an unlocked state in which same is rotatable about the rotation shaft 14*a*. When the document stopper 14 is in a locked state, that is, in a state in which movement thereof is regulated in the abutment position illustrated in FIG. 4, the user is able to determine the position of document D in the feeding direction FD due to the leading edge of document D abutting on an abutment surface 14*b* of the document stopper 14. Here, the abutment surface 14*b* is an example of an abutment portion against which the leading edge of document D is abutted. Further, the lock member 18 (refer to FIG. 11B) serving as a first regulating unit regulates the movement of the document stopper 14 to the abutment position when the pickup roller 4 is located in the standby position. That is, the lock member 18 is configured to regulate the document stopper 14 to move from the abutment position in a case where the pickup roller 4 is located in the standby position. Further, the lock member 18 allows the document stopper 14 to move from the abutment position when the pickup roller 4 is located in the feeding position.

The first sensor S1 includes a light-emitting unit Sla as a first light-emitting unit that emits light, and a light-receiving unit S1*b* as a first light-receiving unit capable of receiving the light emitted from the light-emitting unit S1*a*, and an optical path is thus formed between the light-emitting unit S1*a* and the light-receiving unit S1*b*. The flag 12, which serves as a moving member and as a first moving member, is rotatably supported by the cover 11 about a rotation shaft 16, and is rotated (moved) by being pushed by the documents D loaded in the document tray 2. The flag 12 includes a light interrupt portion 15 that is capable of making contact with the document D and that is capable of opening or interrupting the optical path of the first sensor S1. The light interrupt portion 15 is formed in a substantially fan shape such that the length in the feeding direction FD becomes longer toward the lower side, and is capable of swinging about the rotation shaft 16.

The first sensor S1 enters a transmission state in a condition where the optical path is not interrupted by the light interrupt portion 15 and is open, and, according to the present embodiment, is turned OFF at this time. In addition, the first sensor S1 is in a light interrupting state in a condition where the optical path is interrupted by the light interrupt portion 15, and, according to the present embodiment, is turned ON at this time. The first sensor S1 outputs different signals when ON and when OFF. Further, the first sensor S1 detects a sheet based on the position of the flag 12.

The second sensor S2 is disposed downstream of the separation nip N in the feeding direction FD, and has a light-emitting unit and a light-receiving unit. The second sensor S2 is turned ON when light emitted from the light-emitting unit is reflected by the sheet and the light-receiving unit receives the reflected light. On the other hand, in a case where the sheet is not present in the detection position of the second sensor S2 and the light emitted from the light-emitting unit is not reflected by the sheet, the second sensor S2 is turned OFF. As a result, the second sensor S2 is capable of detecting the sheet in a detection position downstream of the separation nip N in the feeding direction FD. The first sensor S1 and the second sensor S2 are provided to the conveyance unit 13 that serves as a body unit.

Control Configuration of Image Reading Apparatus

Figure 5:
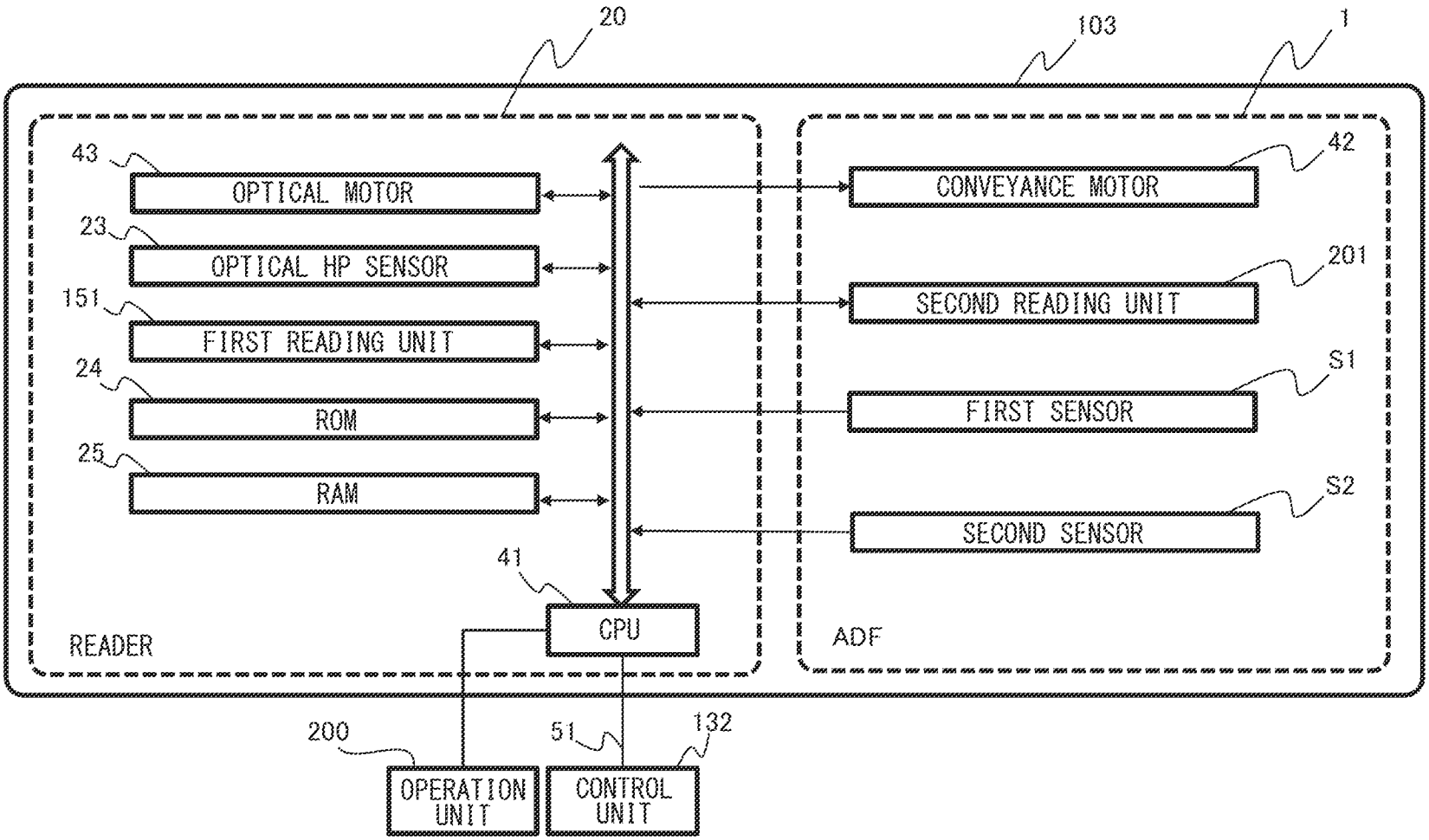
FIG. 5 is a block diagram illustrating a control configuration of the image reading apparatus.

Next, a control configuration of the image reading apparatus 103 will be described with reference to FIG. 5. As illustrated in FIG. 5, the reader 20 includes a CPU 41 that executes a program, a ROM 24, and a RAM 25, and the CPU 41 is a central processing unit that integrally controls each unit of the reader 20 and the ADF 1. The CPU 41 is a storage apparatus that stores the details of control to be executed by a CPU 231 as a program and as data to be used in executing the program. The RAM 25 is a storage apparatus used as a working area necessary for the CPU 41 to perform the control.

The reader 20 also has an optical motor 43, an optical HP sensor 23, and a first reading unit 151. The optical motor 43 is a motor for moving the first reading unit 151 in a sub-scanning direction, and the optical HP sensor 23 is a sensor for detecting the position of the first reading unit 151 in the sub-scanning direction.

The ADF 1 has a conveyance motor 42, a second reading unit 201, a first sensor S1, and a second sensor S2. The conveyance motor 42 drives each roller provided to the ADF 1. The CPU 41 serving as a control unit is capable of controlling each unit and the motor based on signals which are received from the first sensor S1 and the second sensor S2.

In addition, a control unit 132 provided to the printer body 101A and an operation unit 200 are connected to the CPU 41. The control unit 132 is an information processing apparatus that controls the entire image forming apparatus 101 including the image reading apparatus 103. The CPU 41 exchanges control commands relating to image reading control and exchanges control data, together with the control unit 132, via a communication line 51. For example, the control unit 132 receives an image reading operation start instruction via the operation unit 200, and transmits an image reading start request to the CPU 41.

Sheet Feeding Control

Next, the sheet feeding control by the ADF 1 will be described with reference to the flowchart of FIG. 6. The states of the first sensor S1 and the second sensor S2 during sheet feeding control and the positions of the flag 12 and the document stopper 14 will be described with reference to FIGS. 7 to 9C.

Figure 6:
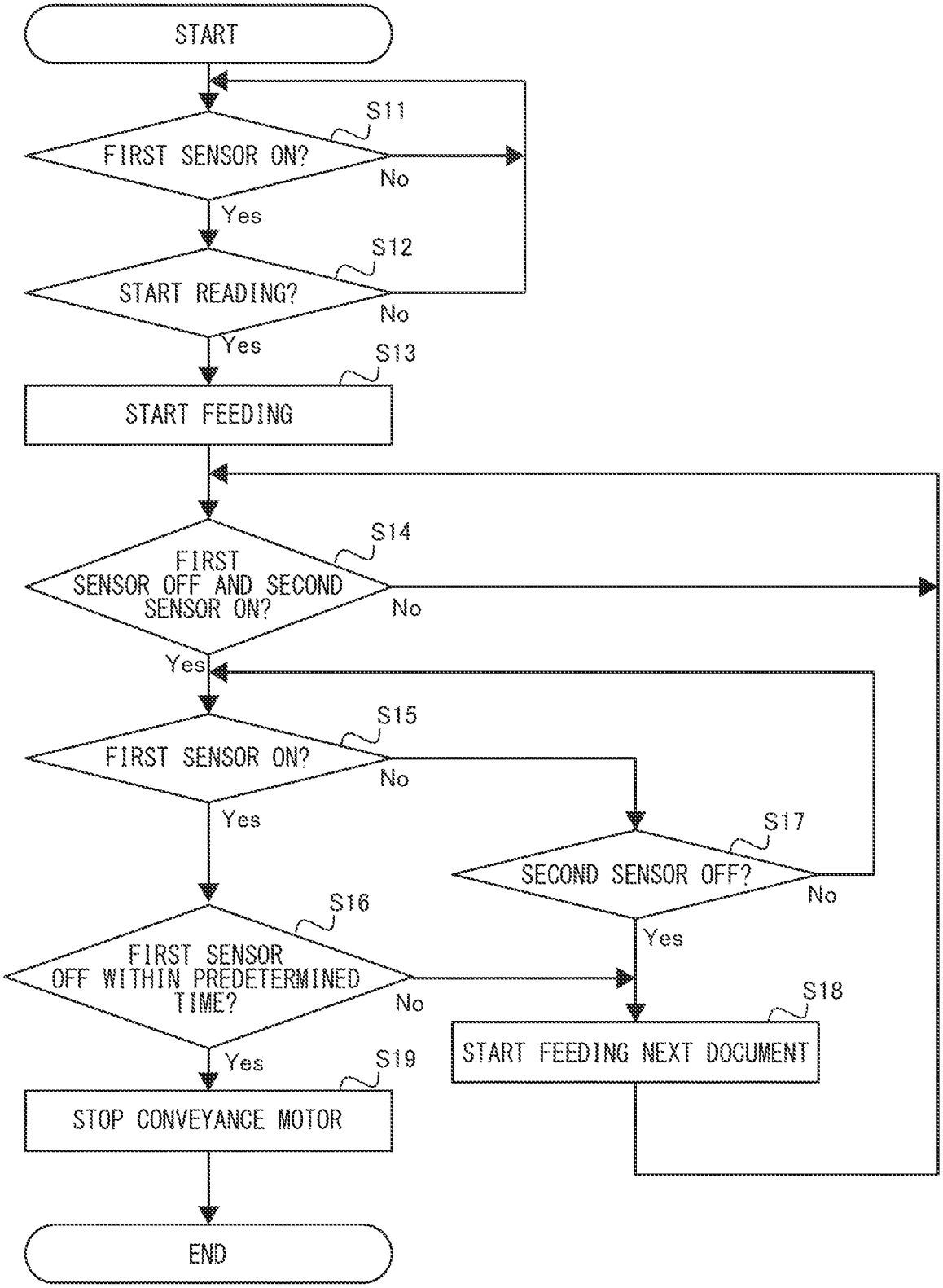
FIG. 6 is a flowchart illustrating sheet feeding control.

When the power of the image reading apparatus 103 is turned ON, the CPU 41 starts each processing of the sheet feeding control illustrated in FIG. 6. First, the CPU 41 determines whether the first sensor S1 is turned ON (S11). In the present embodiment, as illustrated in FIG. 4, in a state where no document is loaded in the document tray 2, the first sensor S1 is turned OFF. Note that the flag 12 including the light interrupt portion 15 is located in the standby position illustrated in FIG. 4 under its own weight or due to a spring (not illustrated), in a natural condition where no external force is acting thereupon.

At this time, a first end portion 15*b* of the light interrupt portion 15 is located upstream in the feeding direction FD with respect to the abutment surface 14*b* of the document stopper 14 located in the abutment position. The first end portion 15*b* is an upstream end portion of the light interrupt portion 15 in the feeding direction FD, and is capable of making contact with the leading edge of document D, which is placed in the document tray 2. Furthermore, the light interrupt portion 15 is provided on the side opposite to the first end portion 15*b* in the feeding direction FD, and includes a second end portion 15*a* which is a downstream end portion of the light interrupt portion 15 in the feeding direction FD.

Figure 7:
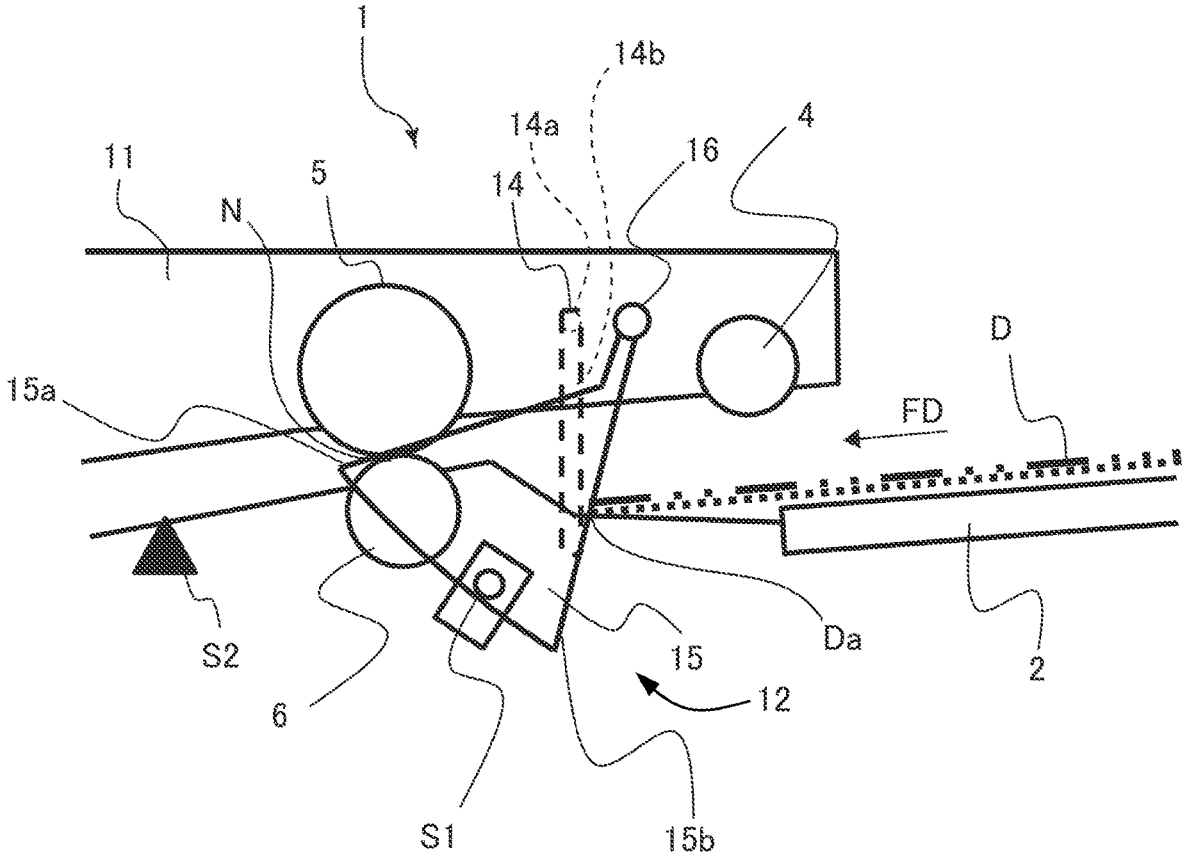
FIG. 7 is a view illustrating an ADF at the time a document is being placed.

As illustrated in FIG. 7, when the document D is placed in the document tray 2 by the user, a leading edge Da of the document D abuts on the abutment surface 14*b* of the document stopper 14, which is locked in the abutment position. At this time, the first end portion 15*b* of the light interrupt portion 15 is pushed by the leading edge Da of the document D, and the flag 12 rotates about the rotation shaft 16. The flag 12 stops in a position in which the contact portion between the first end portion 15*b* and the leading edge Da of the document D reaches the abutment surface 14*b* of the document stopper 14. At this time, the light interrupt portion 15 of the flag 12 interrupts the optical path of the first sensor S1, and the first sensor S1 is turned ON. That is, the first sensor S1 has a function for detecting the presence or absence of a document D on the document tray 2. The control unit 132 determines an existence of a sheet supported by the document tray 2 based on a detection result of the first sensor S1.

As illustrated in FIG. 6, when document D is placed in the document tray 2 and the first sensor S1 is turned ON (S11: Yes), the CPU 41 determines whether a reading start instruction has been inputted by the user via the operation unit 200, for example (S12). In a case where the first sensor S1 is not turned ON in step S11 (S11: No) or in a case where a reading start instruction is not inputted in step S12 (S12: No), the CPU 41 returns to step S11.

In a case where it is determined that a reading start instruction has been inputted (S12: Yes), the CPU 41 drives the conveyance motor 42 to start feeding document D (S13). Note that the reading start instruction includes information such as size information of document D and the number of sheets to be fed. When the conveyance motor 42 is driven, the pickup arm (not illustrated) descends, and the pickup roller 4 descends from the standby position to the feeding position. Further, the rollers, such as the pickup roller 4, the conveyance roller 5, and the separation roller 6, are driven. When the pickup roller 4 moves from the standby position to the feeding position, the document stopper 14 is switched from the locked state to the unlocked state.

Figure 8:
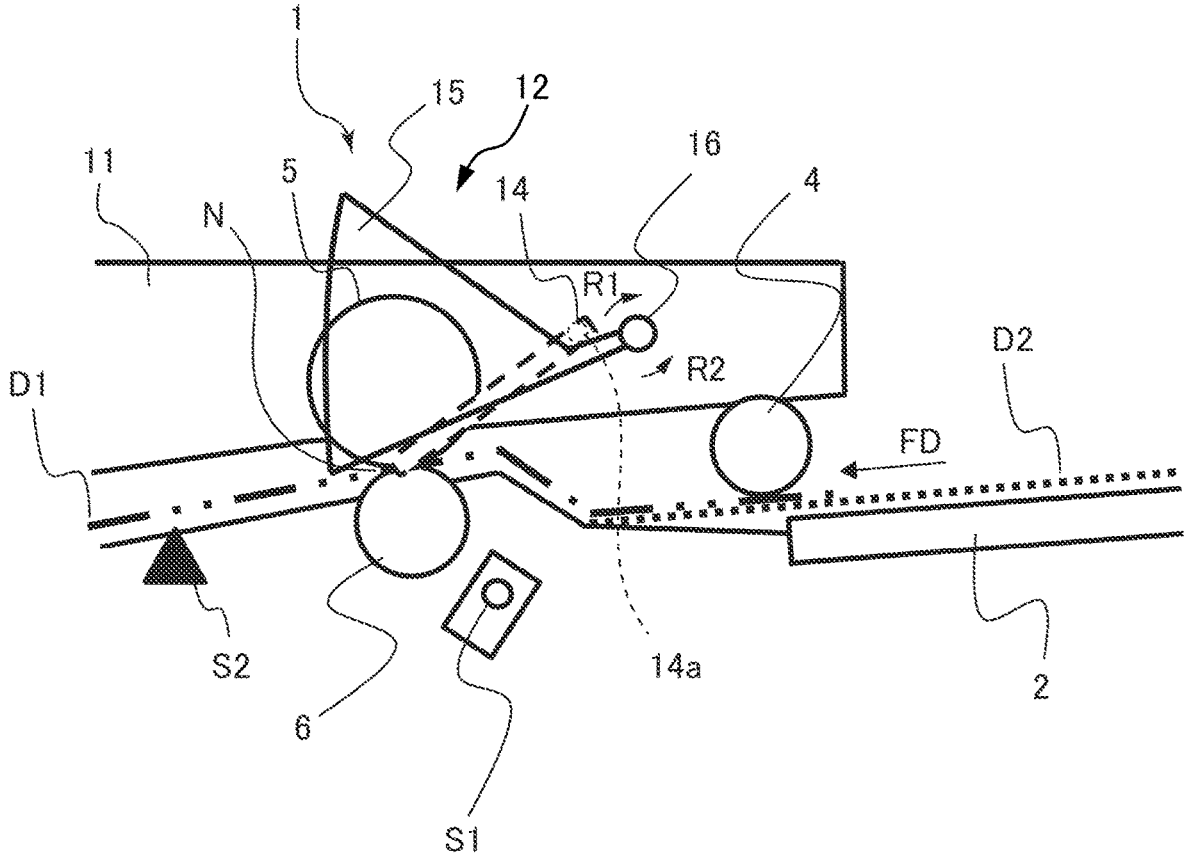
FIG. 8 is a view illustrating an ADF at the time a document is being fed.

Next, the CPU 41 determines whether the first sensor S1 is OFF and the second sensor S2 is ON (S14). FIG. 8 is a view illustrating an aspect in which an uppermost document D1 is being fed by the pickup roller 4. As illustrated in FIG. 8, when document D1 is being fed by the pickup roller 4, the flag 12 rotates in direction R1 about the rotation shaft 16 as a result of the first end portion 15*b* of the light interrupt portion 15 being pushed by the leading edge of document D1. Thus, the first sensor S1 is switched to OFF. Further, while a fed document D2 is passing through the detection position of the second sensor S2, the second sensor S2 is turned ON. Note that the document stopper 14 in the unlocked state is also pressed by the leading edge of document D1 and rotates about the rotation shaft 14*a*.

In this manner, in a case where the first sensor S1 is turned OFF and the second sensor S2 is turned ON in the state illustrated in FIG. 8 (S14: Yes), the CPU 41 determines whether the first sensor S1 is turned ON (S15).

Here, when the trailing edge of document D1 passes through the flag 12, the flag 12 rotates about the rotation shaft 16 in direction R2 of FIG. 8 under its own weight or due to a spring (not illustrated), and attempts to return to the standby position. Further, in a case where document D2, which constitutes a second sheet which succeeds document D1 constituting a first sheet, is loaded in the document tray 2, the position in which the flag 12 stops rotating differs according to the position of document D2.

Figure 9A:
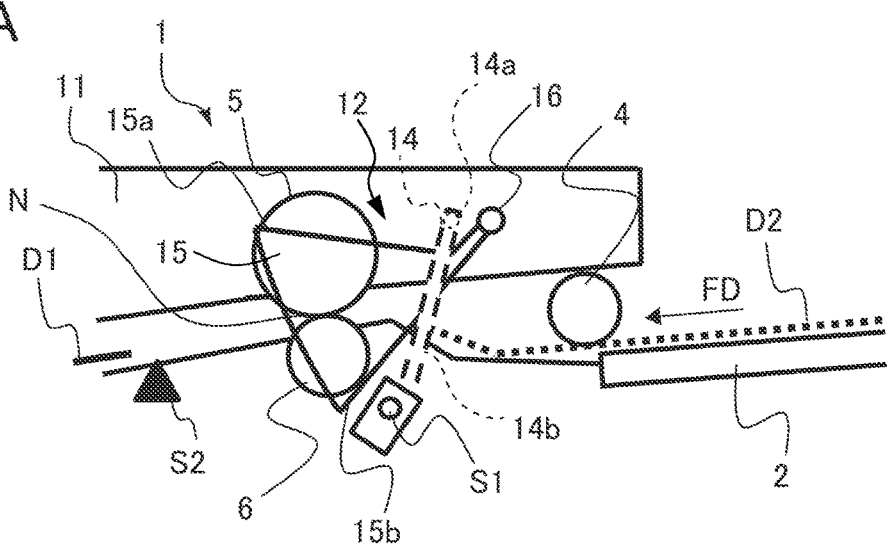
FIG. 9A is a view illustrating a state in which a succeeding document is being multi-fed.

As illustrated in FIG. 9A, sometimes a document D2, which is loaded in the document tray 2 adjacent and superposed to document D1, is moved downstream in the feeding direction FD along with the fed document D1. That is, document D2 advances together with document D1 in the feeding direction FD as a result of the relationship between a frictional force between document D1 and document D2 and a frictional force between document D2 and document tray 2 or an adjacent and superposed succeeding document below document D2. Such a phenomenon will be referred to as multi-feed hereinbelow.

For example, as illustrated in FIG. 9A, the leading edge of document D2, which has been multi-fed, advances downstream in the feeding direction FD from the position in which document D2 was originally placed. Further, as described above, the trailing edge of document D1 passes through the flag 12, and the first end portion 15*b* of the light interrupt portion 15 of the flag 12, which attempts to return to the standby position under its own weight or due to a spring (not illustrated), abuts on the leading edge of document D2. At this time, because the flag 12 that has stopped rotating is not blocking the optical path of the first sensor S1, the first sensor S1 remains OFF.

Figure 9B:
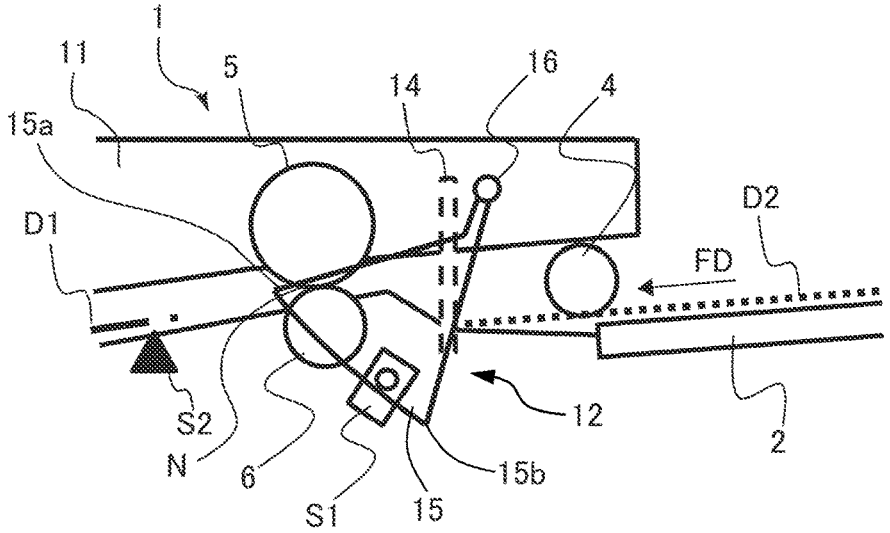
FIG. 9B is a view illustrating a state in which a succeeding document is not being multi-fed.

Meanwhile, as illustrated in FIG. 9B, document D2 may also not be multi-fed. In this case, because the trailing edge of document D1 passes through the flag 12, the flag 12 stops in the same position as in FIG. 7, that is, at the start of document feeding. Therefore, the optical path of the first sensor S1 is interrupted by the flag 12, and the first sensor S1 is turned ON.

That is, in step S15 of FIG. 6, the case where the first sensor S1 is turned ON is a case where document D2, which succeeds document D1 and is not being multi-fed, is loaded in the document tray 2, as illustrated in FIG. 9B. In a case where the first sensor S1 is turned ON (S15: Yes), the CPU 41 determines whether the first sensor S1 is turned OFF within a predetermined time t2 (S16). The predetermined time t2 is the time required for the flag 12, which turns in direction R2 (see FIG. 8), to return to the standby position (see FIG. 4) after the first end portion 15*b* of the light interrupt portion 15 of the flag 12 passes through the optical path of the first sensor S1.

That is, as illustrated in FIG. 9B, in a case where document D2, which succeeds document D1, is in the document tray 2, the flag 12 abuts on the leading edge of document D2 and thus stops without rotating to the standby position (see FIG. 4). Therefore, the first sensor S1 remains ON even when the predetermined time t2 has elapsed since the first sensor S1 is turned ON (S15: Yes).

Figure 9C:
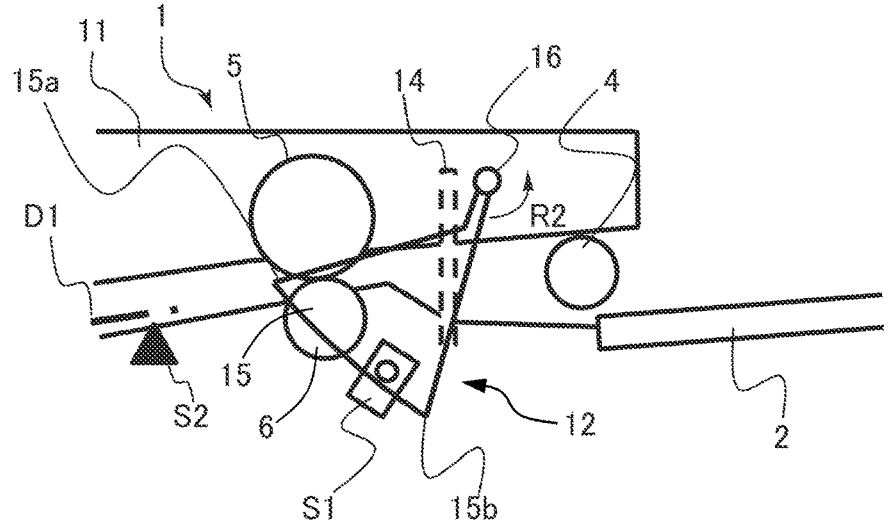
FIG. 9C is a view illustrating a state in which there is no document in a document tray.

On the other hand, as illustrated in FIG. 9C, in a case where there is no document succeeding document D1 in the document tray 2, the flag 12 rotates in direction R2 and returns to the standby position illustrated in FIG. 4. Therefore, the first sensor S1 is turned OFF when the predetermined time t2 has elapsed since the first sensor S1 is turned ON (S15: Yes). In this manner, it is possible to determine the presence or absence of a document on the document tray 2 by checking whether the first sensor S1 is switched from ON to OFF within the predetermined time t2.

That is, in step S16 of FIG. 6, in a case where the first sensor S1 is not turned OFF within the predetermined time t2 (S16: No), because document D2, which is not being multi-fed, is in the document tray 2, the CPU 41 starts feeding the next document (D2) (S18). After the next document is fed, the CPU 41 returns to the processing of step S14.

In a case where the first sensor S1 is turned OFF within the predetermined time t2 (S16: Yes), because there is no document in the document tray 2, the CPU 41 stops the conveyance motor 42 (S19), and ends the sheet feeding control.

As described above, in a case where document D2 is multi-fed with the preceding document D1 and the first sensor S1 is not turned ON in S15 (S15: No), the CPU 41 determines whether the second sensor S2 is turned OFF (S17). In a case where the second sensor S2 is not turned OFF (S17: No), document D1 is still passing through the second sensor S2, and the CPU 41 returns to step S15.

In a case where the second sensor S2 is turned OFF (S17: Yes), the CPU 41 determines that the trailing edge of document D1 has passed through the detection position of the second sensor S2, and starts feeding the succeeding document D2 (S18). After feeding the document, the CPU 41 returns to the processing of step S14.

In the present embodiment, for example, after the feeding of document D1 is started (S13) and the first sensor S1 is turned OFF and the second sensor S2 is turned ON (S14: Yes), it is determined whether the first sensor S1 is turned ON after a predetermined time t1 (S15). The predetermined time t1 is a time calculated based on the document size information inputted by the user to the control unit 132. For example, the predetermined time t1 is the time from when the leading edge of document D1 reaches the detection position of the second sensor S2 until the state of FIG. 9B is reached.

In a case where there is a succeeding document D2 which has been multi-fed to the document tray 2 (S15: No), it is necessary, from the viewpoint of the characteristics of the reading unit and jamming, to leave a predetermined sheet interval between the preceding document D1 and the succeeding document D2. Therefore, in the present embodiment, the feeding of document D2 is started at the timing when the second sensor S2 is turned OFF (S17). Because the leading edge of document D2 does not advance downstream of the separation nip N in the feeding direction FD due to multi-feeding, a sheet interval can be reliably secured between document D1 and document D2.

Furthermore, in the present embodiment, it is determined whether the succeeding document D2 has been multi-fed by determining whether the first sensor S1 is turned ON in step S15, and the feeding timing of document D2 is changed accordingly. More specifically, the first sensor S1 outputs an ON signal as a first signal in a state in which the leading edge of document D2 that is not being multi-fed is in contact with the flag 12 and the abutment surface 14*b* of the document stopper 14 in the locked state. Further, the first sensor S1 outputs an OFF signal as a second signal in a state where the flag 12 is in contact with the leading edge of document D2 which has been multi-fed, a state where the flag 12 is in contact with a surface of the document fed by the pickup roller 4 after the leading edge of the document pass through the flag 12, and a state where the flag is not in contact with documents D1 and D2. In addition, the second sensor S2 outputs an ON signal as a third signal in a case where document D1 is in a predetermined detection position, and outputs an OFF signal as a fourth signal, which is different from the third signal, in a case where document D1 is not in the detection position. For example, in a case where document D2 is not being multi-fed (S15: Yes), the CPU 41 causes the pickup roller 4 to feed document D2 at first feeding timing. In other words, in a case where the first sensor S1 outputs an ON signal after document D1 is fed and the second sensor S2 outputs the ON signal, and the first sensor S1 does not output an OFF signal within the predetermined time t2 after the first sensor S1 outputs the ON signal, the CPU 41 feeds document D2 at the first feeding timing. Further, in a case where the first sensor S1 outputs an ON signal after document D1 is fed and the second sensor S2 outputs the ON signal, and the first sensor S1 outputs an OFF signal within the predetermined time t2 after the first sensor S1 outputs the ON signal, the CPU 41 stops the pickup roller 4.

Further, in a case where document D2 is being multi-fed (S15: No), the CPU 41 causes the pickup roller 4 to feed document D2 at second timing, which lags the first feeding timing. In other words, in a case where the first sensor S1 outputs the OFF signal and the second sensor S2 outputs the OFF signal after document D1 is fed and the second sensor S2 outputs the ON signal, the CPU 41 feeds document D2 at the second feeding timing.

In other words, in a case where document D2 is not being multi-fed (S15: Yes), the pickup roller 4 feeds document D2 at the first feeding timing after a first time has elapsed since the timing when the first sensor S1 is turned OFF and the second sensor S2 is turned ON. In a case where document D2 is being multi-fed (S15: No), the pickup roller 4 feeds document D2 at the second feeding timing after a second time, which is longer than the first time, has elapsed since the timing when the first sensor S1 is turned OFF and the second sensor S2 is turned ON.

As described above, in the present embodiment, the presence or absence of a document loaded in the document tray 2 is detected based on the detection result of the first sensor S1. Further, in the present embodiment, the feeding timing at which the pickup roller 4 starts feeding the document is controlled based on the detection results of the first sensor S1 and the second sensor S2. That is, the document feeding timing is changed according to the position of the leading edge of the document loaded in the document tray 2. More specifically, when the leading edge of document D2, which succeeds document D1, is located at the first position illustrated in FIG. 9B, the CPU 41 feeds document D2 at the first feeding timing. In addition, in a case where the leading edge of document D2 is located at a second position downstream of the first position with respect to the feeding direction FD illustrated in FIG. 9A, the CPU 41 feeds document D2 at the second feeding timing. Therefore, variation in the sheet interval can be suppressed and the sheet interval can be shortened, thus improving productivity.

Further, because the first sensor S1 has a function for detecting the presence or absence of a document on the document tray 2 and a function for detecting the document feeding timing, the number of sensors can be reduced in comparison with a case where such functions are realized by providing separate sensors. Therefore, space can be saved, enabling a more compact and lower-cost apparatus.

Second Embodiment

Next, a second embodiment of the present invention will be described. The second embodiment has a configuration in which the flag 12 is afforded the functions of the document stopper 14 according to the first embodiment. Therefore, a configuration similar to that of the first embodiment will be described by omitting drawings or attaching the same reference signs to the drawings.

Figure 10:
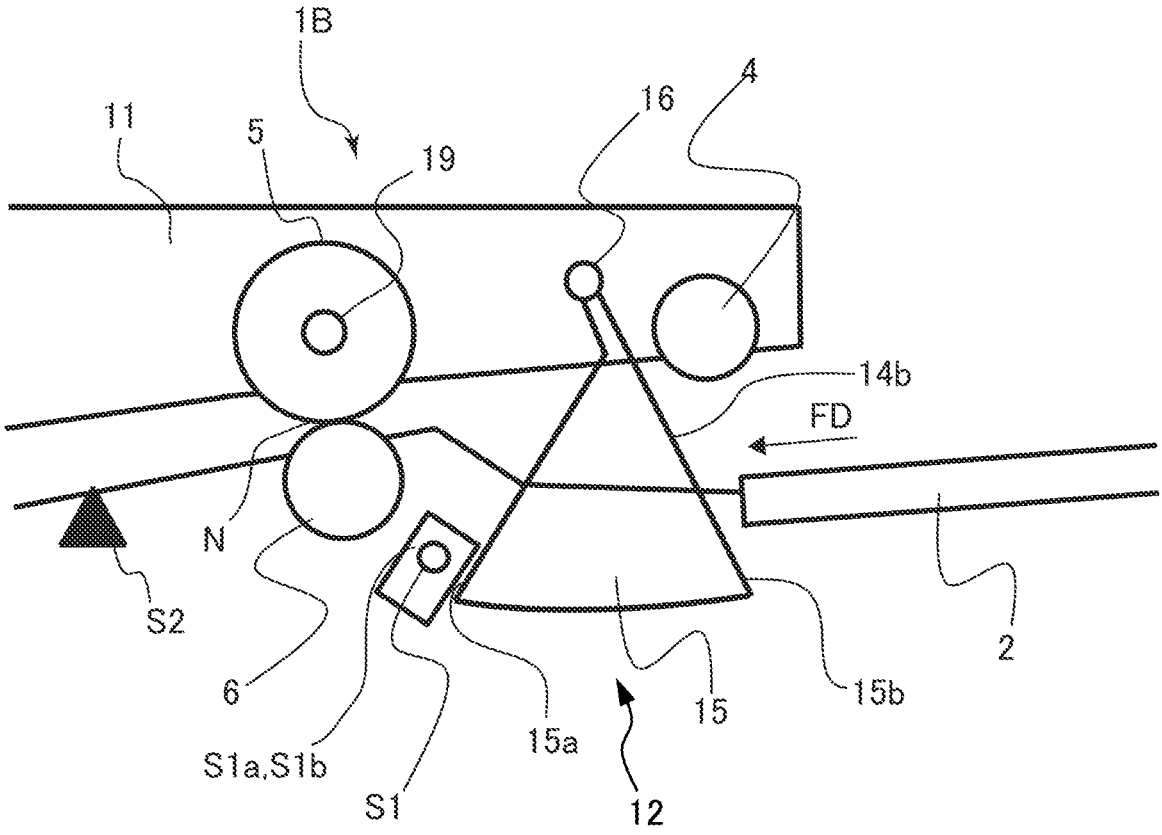
FIG. 10 is a view illustrating an ADF according to a second embodiment.
Figure 11A:
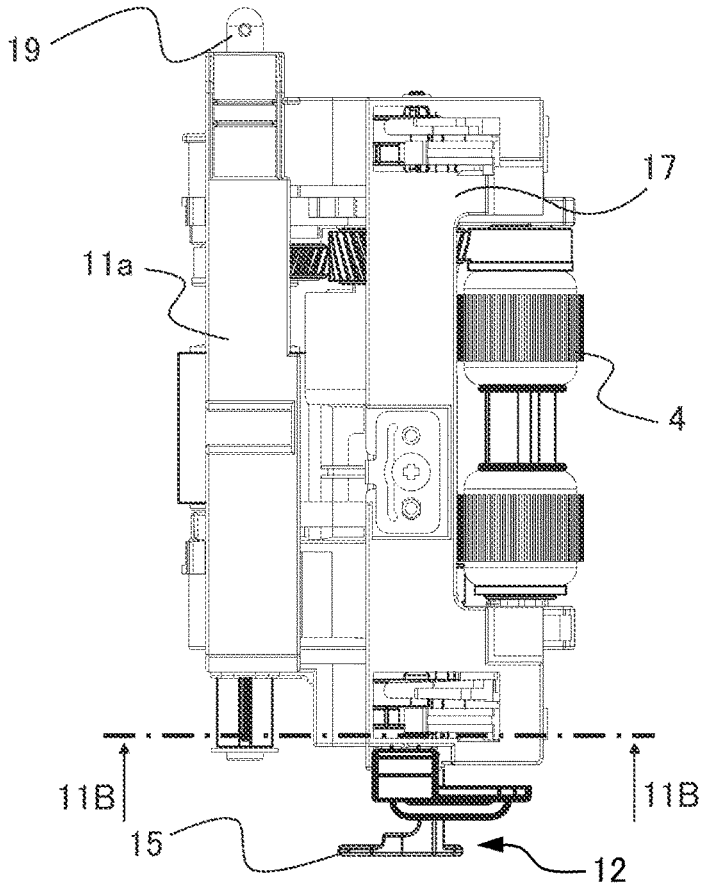
FIG. 11A is a plan view illustrating a sheet feeding configuration of the ADF.
Figure 11B:
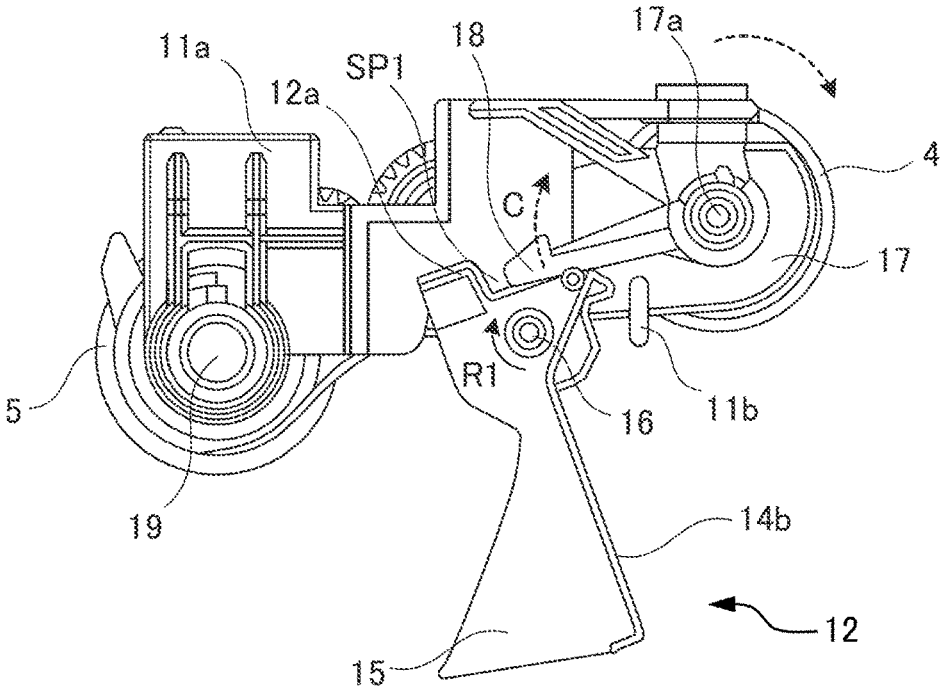
FIG. 11B is a cross-sectional view showing a cross-section taken along line 11B-11B in FIG. 11A.

As illustrated in FIG. 10, an ADF 1B according to the present embodiment has the same configuration as the ADF 1 according to the first embodiment except that the document stopper 14 (see FIG. 4) is not provided. As illustrated in FIGS. 11A and 11B, a feed shaft 19, which is a rotation shaft of the conveyance roller 5, is rotatably supported by the cover 11, and a pickup arm 17 is swingably supported by the feed shaft 19. A flag holder 11*a*, which rotatably supports the flag 12 about the rotation shaft 16, is fixed to the cover 11. That is, the pickup arm 17 is rotatable with respect to the cover 11 and the flag holder 11*a*.

A roller shaft 17*a* is rotatably supported by the pickup arm 17, and the pickup roller 4 is supported by the roller shaft 17*a*. The drive of the feed shaft 19 is transmitted to the pickup roller 4 by a drive train (not illustrated). Therefore, when the feed shaft 19 is driven by the conveyance motor 42, the conveyance roller 5 and the pickup roller 4 rotate.

Further, the pickup arm 17 is connected to the feed shaft 19 via a spring clutch (not illustrated). When the feed shaft 19 is rotated by the conveyance motor 42, the spring clutch is fixed to the feed shaft 19, and the pickup arm 17 swings downward about the feed shaft 19. The pickup atm 17 supports a lock member 18 that is rotatable about the roller shaft 17*a*, and the lock member 18 is configured to be capable of engaging with a protrusion 12*a* provided to the flag 12.

When the pickup roller 4 is located in the standby position, there is a gap SP1 between the protrusion 12*a* of the flag 12 and the lock member 18. The flag 12 has an abutment surface 14*b* on which the leading edge of the document abuts, and when the leading edge of the document is pushed by the user against the abutment surface 14*b*, the flag 12 rotates about the rotation shaft 16 by an amount corresponding to the gap SP1. When the protrusion 12*a* of the flag 12 and the lock member 18 are in contact with each other, the flag 12 is located in the abutment position. The document stopper 14 is configured to move between an abutment position and a moving position by being pushed by the document. Rotation of the flag 12 located in the abutment position in direction R1 (clockwise direction) in FIG. 11B is regulated by the lock member 18. The lock member 18 is configured to regulate the flag 12 to move from the abutment position in a case where the pickup roller 4 is located in the standby position. That is, the lock member 18 serving as the second regulating unit regulates the movement of the flag 12 to the abutment position when the pickup roller 4 is located in the standby position, and allows the flag 12 to move from the abutment position when the pickup roller 4 is located in the feeding position.

When the document reading start instruction is outputted and the conveyance motor 42 is driven, the pickup arm 17 swings downward about the feed shaft 19 as described above. As a result, the pickup roller 4 moves from the standby position to the feeding position. At this time, the lock member 18 is pushed by a rib 11*b* of the flag holder 11*a* so as to rotate in a direction C about the roller shaft 17*a*. As a result, the lock member 18 is spaced apart from the protrusion 12*a* of the flag 12 and releases the lock of the flag 12. That is, the flag 12 is switched from the locked state to the unlocked state. The flag 12 in the unlocked state can be rotated in direction R1 about the rotation shaft 16 due to the abutment surface 14*b* being pushed by the document, for example.

Note that the document stopper 14 according to the first embodiment can also be switched, by the lock member 18 and the rib 11*b* of the present embodiment, between the unlocked state and the locked state in conjunction with the raising and lowering of the pickup arm 17. That is, the lock member 18 serving as the first regulating unit regulates the movement of the document stopper 14 to the abutment position when the pickup roller 4 is located in the standby position. Further, the lock member 18 allows the document stopper 14 to move from the abutment position when the pickup roller 4 is located in the feeding position.

Sheet Feeding Control

Next, the sheet feeding control by the ADF 1B will be described with reference to the flowchart of FIG. 6. Because the sheet feeding control of the present embodiment is similar to that of the first embodiment, a description will be provided with reference to the same flowchart. Furthermore, the states of the first sensor S1 and the second sensor S2 during the sheet feeding control and the position of the flag 12 will be described with reference to FIGS. 12 to 14C.

When the power of the image reading apparatus 103 is turned ON, the CPU 41 starts each processing of the sheet feeding control illustrated in FIG. 6. First, the CPU 41 determines whether the first sensor S1 is turned ON (S11). In the present embodiment, as illustrated in FIG. 10, in a state where no document is loaded in the document tray 2, the first sensor S1 is turned OFF. Note that the flag 12 including the light interrupt portion 15 is located at the standby position illustrated in FIG. 10 under its own weight or due to a spring (not illustrated), in a natural condition where no external force is acting thereupon.

Figure 12:
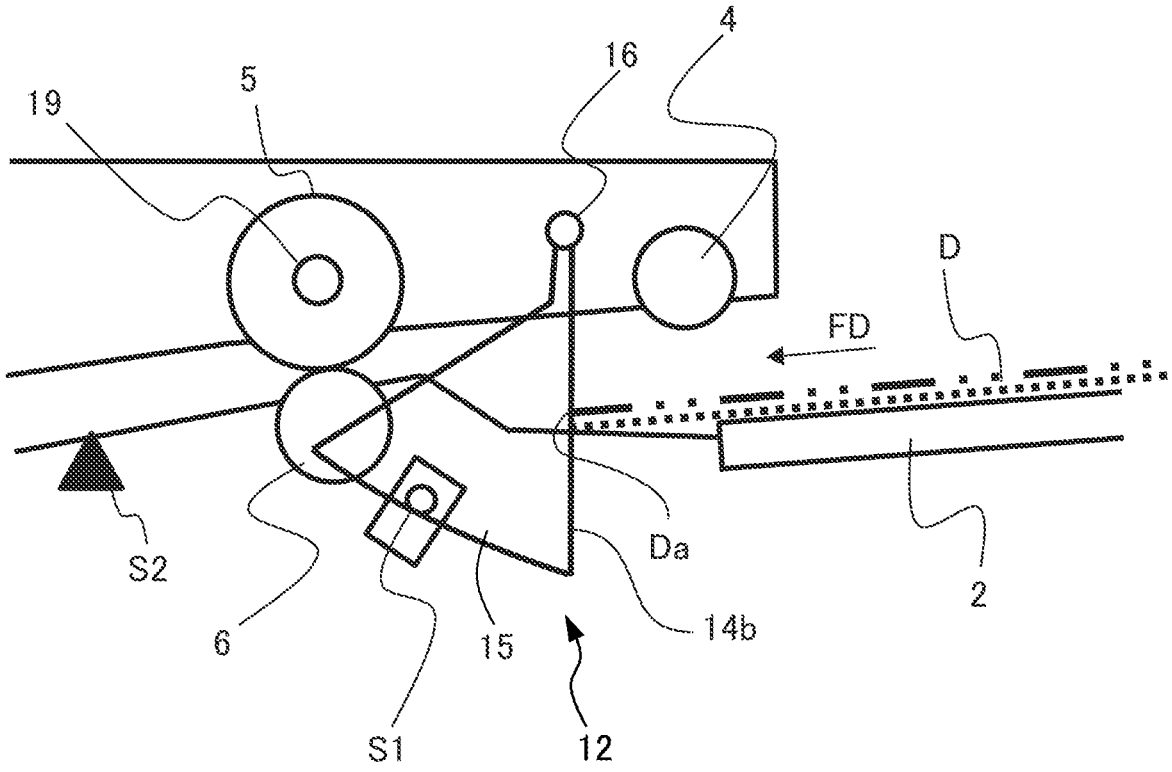
FIG. 12 is a view illustrating the ADF at the time a document is being placed.

At this time, the first end portion 15*a* of the light interrupt portion 15 is located upstream, in the feeding direction FD, of the light-emitting unit S1*a* and the light-receiving unit S1*b* of the first sensor S1. As illustrated in FIGS. 10 and 12, when the user places document D in the document tray 2, the leading edge Da of document D abuts on the abutment surface 14*b* of the flag 12 located in the standby position. As a result, the flag 12 is pushed by the leading edge Da of document D and rotates about the rotation shaft 16 by an amount corresponding to the gap SP1. The protrusion 12*a* of the flag 12 and the lock member 18 are brought into contact with each other so as to be located in the abutment position illustrated in FIG. 12. At this time, the light interrupt portion 15 of the flag 12 interrupts the optical path of the first sensor S1, and the first sensor S1 is turned ON. That is, the first sensor S1 has a function for detecting the presence or absence of a document D on the document tray 2.

As illustrated in FIG. 6, when document D is placed in the document tray 2 and the first sensor S1 is turned ON (S11: Yes), the CPU 41 determines whether a reading start instruction has been inputted by the user via the operation unit 200, for example (S12). In a case where the first sensor S1 is not turned ON in step S11 (S11: No) or in a case where a reading start instruction is not inputted in step S12 (S12: No), the CPU 41 returns to step S11.

In a case where it is determined that a reading start instruction has been inputted (S12: Yes), the CPU 41 drives the conveyance motor 42 to start feeding document D (S13). Note that the reading start instruction includes information such as size information of document D and the number of sheets to be fed. When the conveyance motor 42 is driven, the pickup arm 17 (see FIG. 11B) descends, and the pickup roller 4 descends from the standby position to the feeding position. Further, the rollers, such as the pickup roller 4, the conveyance roller 5, and the separation roller 6, are driven. When the pickup roller 4 moves from the standby position to the feeding position, the flag 12 is switched from the locked state to the unlocked state.

Figure 13:
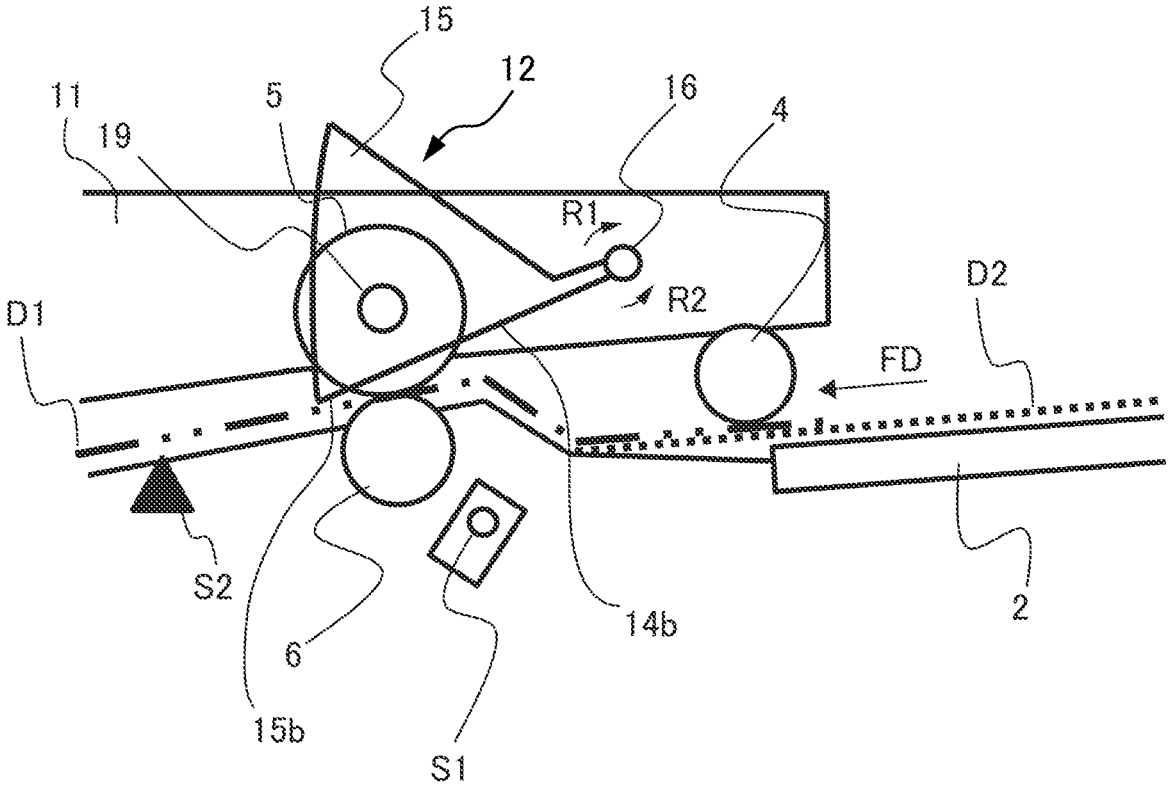
FIG. 13 is a view illustrating the ADF at the time a document is being fed.

Next, the CPU 41 determines whether the first sensor S1 is OFF and the second sensor S2 is ON (S14). FIG. 13 is a view illustrating an aspect in which an uppermost document D1 is fed by the pickup roller 4. Note that, in FIG. 13, the number of sets of the documents D is described as two, but the number of sets is not limited to that number. As illustrated in FIG. 13, when document D1 is being fed by the pickup roller 4, the flag 12 rotates in direction R1 about the rotation shaft 16 as a result of the abutment surface 14*b* of the light interrupt portion 15 being pushed by the leading edge of document D1. Thus, the first sensor S1 is switched to OFF. Further, while a fed document D2 is passing through the detection position of the second sensor S2, the second sensor S2 is turned ON.

In this manner, in a case where the first sensor S1 is turned OFF and the second sensor S2 is turned ON in the state illustrated in FIG. 13 (S14: Yes), the CPU 41 determines whether the first sensor S1 is turned ON (S15).

Here, when the trailing edge of document D1 passes through the flag 12, the flag 12 rotates about the rotation shaft 16 in direction R2 in FIG. 13 under its own weight or due to a spring (not illustrated), and attempts to return to the standby position. Further, in a case where document D2, which succeeds document D1, is loaded in the document tray 2, the position in which the flag 12 stops rotating differs according to the position of document D2.

Figure 14A:
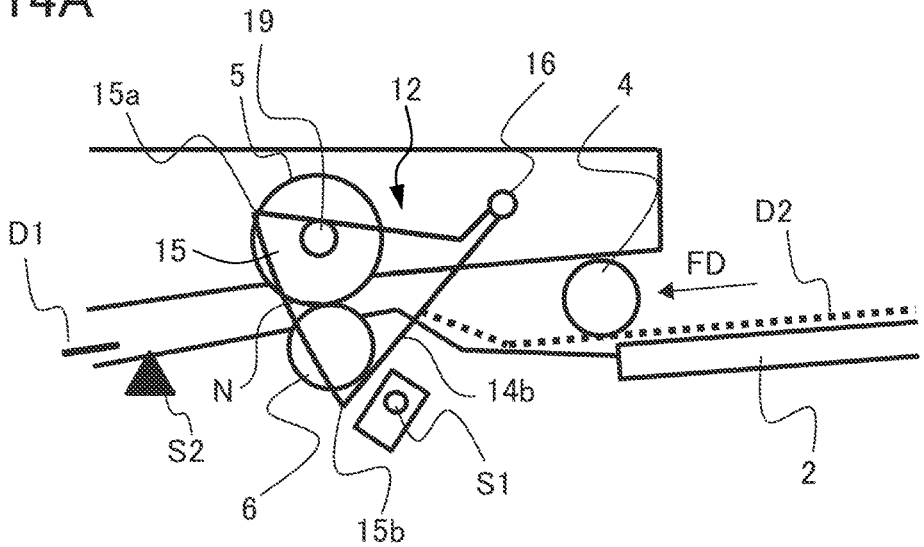
FIG. 14A is a view illustrating a state in which a succeeding document is being multi-fed.

As illustrated in FIG. 14A, sometimes a document D2, which is loaded in the document tray 2 adjacent and superposed to document D1, is moved downstream in the feeding direction FD along with the fed document D1. That is, document D2 advances together with document D1 in the feeding direction FD as a result of the relationship between a frictional force between document D1 and document D2 and a frictional force between document D2 and document tray 2 or an adjacent and superposed succeeding document below document D2. Such a phenomenon will be referred to as multi-feed hereinbelow.

For example, as illustrated in FIG. 14A, the leading edge of document D2, which has been multi-fed, advances downstream in the feeding direction FD from the position in which document D2 was originally placed. Further, as described above, the trailing edge of document D1 passes through the flag 12, and the abutment surface 14*b* of the light interrupt portion 15 of the flag 12, which attempts to return to the standby position under its own weight or due to a spring (not illustrated), abuts on the leading edge of document D2. At this time, because the flag 12 that has stopped rotating is not blocking the optical path of the first sensor S1, the first sensor S1 remains OFF.

Figure 14B:
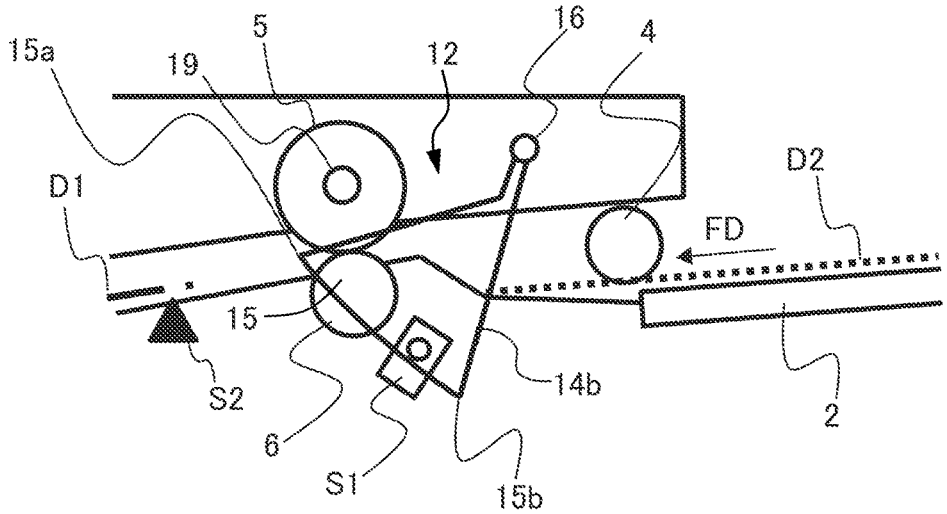
FIG. 14B is a view illustrating a state in which a succeeding document is not being multi-fed.

Meanwhile, as illustrated in FIG. 14B, document D2 may also not be multi-fed. In this case, because the trailing edge of document D1 passes through the flag 12, the flag 12 stops in the same position as in FIG. 12, that is, at the start of document feeding. Therefore, the optical path of the first sensor S1 is interrupted by the flag 12, and the first sensor S1 is turned ON.

That is, in step S15 of FIG. 6, the case where the first sensor S1 is turned ON is a case where document D2, which succeeds document D1 and is not multi-fed, is loaded in the document tray 2, as illustrated in FIG. 14B. In a case where the first sensor S1 is turned ON (S15: Yes), the CPU 41 determines whether the first sensor S1 is turned OFF within a predetermined time t2 (S16). The predetermined time t2 is the time required for the flag 12, which turns in direction R2 (see FIG. 13), to return to the standby position (see FIG. 12) after the first end portion 15*b* of the light interrupt portion 15 of the flag 12 passes through the optical path of the first sensor S1.

That is, as illustrated in FIG. 14B, in a case where document D2, which succeeds document D1, is in the document tray 2, the flag 12 abuts on the leading edge of document D2 and thus stops without rotating to the standby position (see FIG. 12). Therefore, the first sensor S1 remains ON even when the predetermined time t2 has elapsed since the first sensor S1 is turned ON (S15: Yes).

Figure 14C:
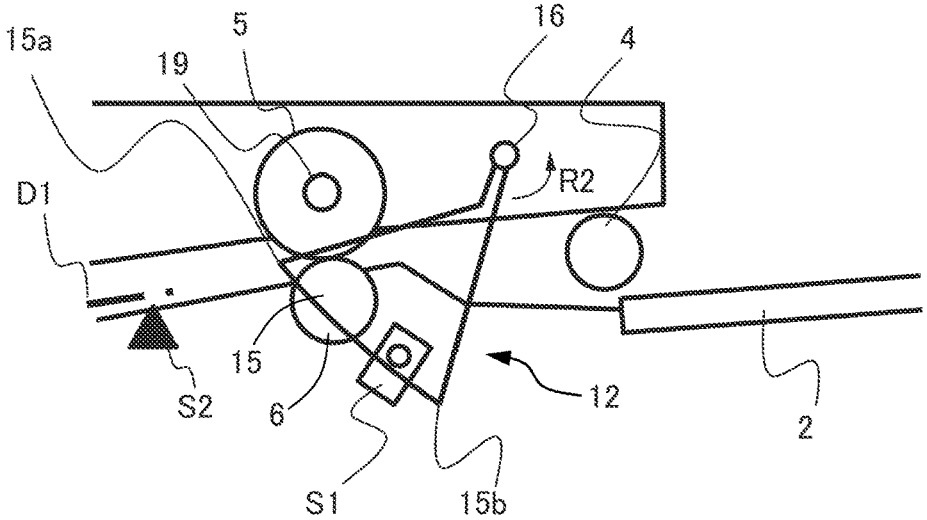
FIG. 14C is a view illustrating a state in which there is no document in the document tray.

On the other hand, as illustrated in FIG. 14C, in a case where there is no document succeeding document D1 in the document tray 2, the flag 12 rotates in direction R2 and returns to the standby position illustrated in FIG. 10. Therefore, the first sensor S1 is turned OFF when the predetermined time t2 has elapsed since the first sensor S1 is turned ON (S15: Yes). In this manner, it is possible to determine the presence or absence of a document on the document tray 2 by checking whether the first sensor S1 is switched from ON to OFF within the predetermined time t2.

That is, in step S16 of FIG. 6, in a case where the first sensor S1 is not turned OFF within the predetermined time t2 (S16: No), because document D2, which is not being multi-fed, is in the document tray 2, the CPU 41 starts feeding the next document (D2) (S18). After the next document is fed, the CPU 41 returns to the processing of step S14.

In a case where the first sensor S1 is turned OFF within the predetermined time t2 (S16: Yes), because there is no document in the document tray 2, the CPU 41 stops the conveyance motor 42 (S19), and ends the sheet feeding control.

As described above, in a case where document D2 is multi-fed with the preceding document D1 and the first sensor S1 is not turned ON in S15 (S15: No), the CPU 41 determines whether the second sensor S2 is turned OFF (S17). In a case where the second sensor S2 is not turned OFF (S17: No), document D1 is still passing through the second sensor S2, and the CPU 41 returns to step S15.

In a case where the second sensor S2 is turned OFF (S17: Yes), the CPU 41 determines that the trailing edge of document D1 has passed through the detection position of the second sensor S2, and starts feeding the succeeding document D2 (S18). After feeding the document, the CPU 41 returns to the processing of step S14.

The feeding timing of a document D2 which has been multi-fed (see FIG. 14A) and a document D2 which is not being multi-fed (see FIG. 14B) is similar to that of the first embodiment, and thus, a description thereof is omitted. In other words, in a case where document D2 is not being multi-fed (S15: Yes), the pickup roller 4 feeds document D2 at first feeding timing. Further, in a case where document D2 is being multi-fed (S15: No), the pickup roller 4 feeds document D2 at second timing, which lags the first feeding timing.

As described above, in the present embodiment, because the document feeding timing is changed according to the position of the leading edge of the document loaded in the document tray 2, variation in the sheet interval can be suppressed and the sheet interval can be shortened, thus improving productivity. Further, because the first sensor S1 has a function for detecting the presence or absence of a document on the document tray 2 and a function for detecting the document feeding timing, the number of sensors can be reduced in comparison with a case where such functions are realized by providing separate sensors. Therefore, space can be saved, enabling a more compact and lower-cost apparatus. Furthermore, because the flag 12 also exhibits the functions of the document stopper 14 according to the first embodiment, the number of parts can be further reduced, enabling a more compact and lower-cost apparatus. Further, because the flag 12 has the functions of the document stopper, the flag 12 can be arranged in the center of the conveyance path in the width direction. It is thus possible to handle feeding of a document having a narrow width such as a business card.

Third Embodiment

Next, a third embodiment of the present invention will be described. In the third embodiment, a shutter 21 and a third sensor S3 are added in addition to the configuration of the second embodiment. Therefore, a configuration similar to that of the first embodiment will be described by omitting drawings or attaching the same reference signs to the drawings.

Figure 15:
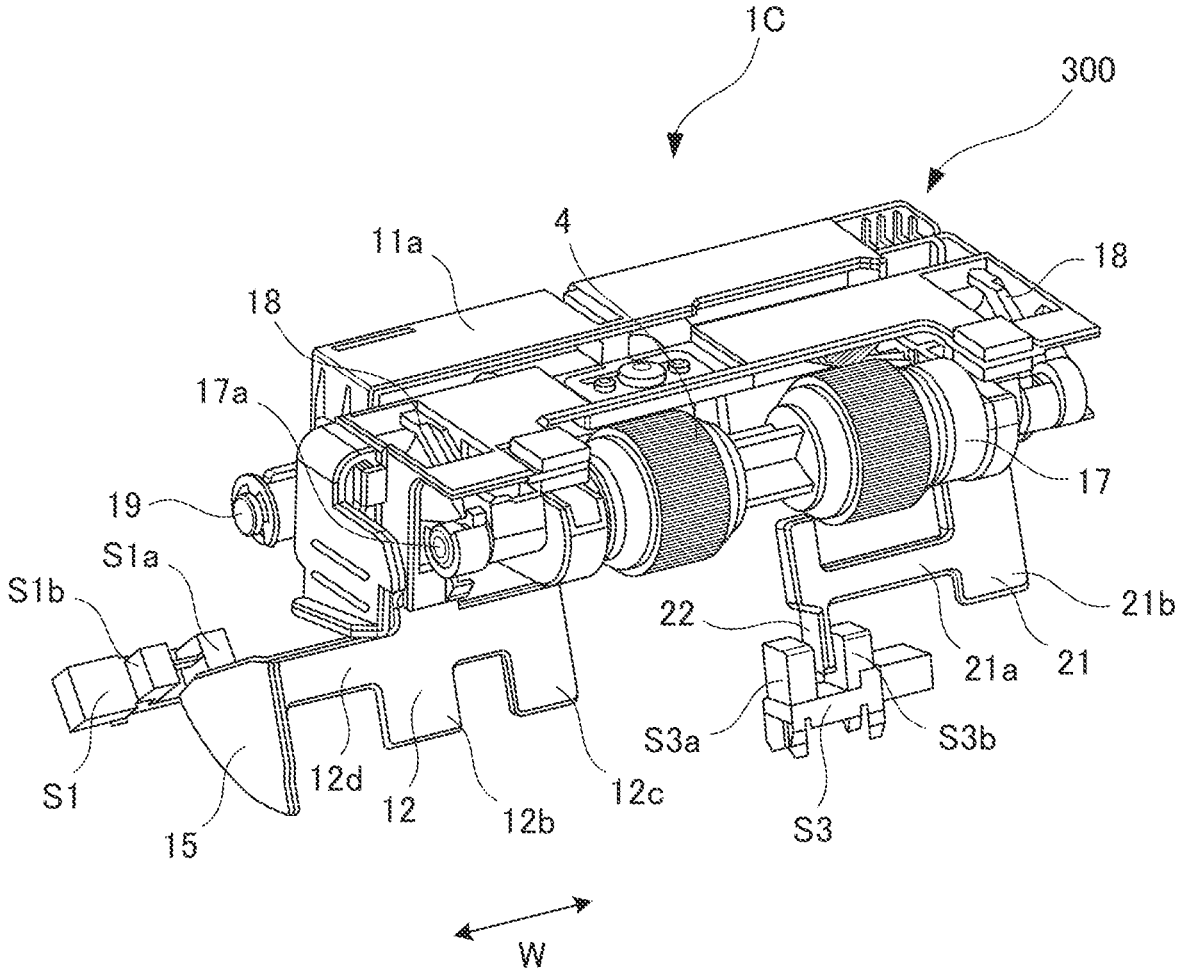
FIG. 15 is a perspective view illustrating a sheet feed unit according to a third embodiment.

As illustrated in FIG. 15, the ADF 1C according to the present embodiment is provided with a sheet feed unit 300 that is supported by the cover 11 (see FIG. 2). The sheet feed unit 300 includes a feed shaft 19 that supports the conveyance roller 5, a pickup arm 17 that is swingably supported about the feed shaft 19, and a pickup roller 4 that is rotatably supported by the pickup arm 17 about a roller shaft 17*a*.

Further, the sheet feed unit 300 includes a flag holder 11*a* fixed to the cover 11, and the flag 12 and the shutter 21, which are rotatably supported by the flag holder 11*a* about the rotation shaft 16. The flag 12 includes a light interrupt portion 15 capable of interrupting the optical path of the first sensor S1, a first portion 12*d*, and a second portion 12*b* and a third portion 12*c* that extend downward from the first portion 12*d*. The light interrupt portion 15 is provided at an end portion of the first portion 12*d* in a width direction W. The width direction W is a direction orthogonal to the feeding direction FD.

The shutter 21 has a first portion 21*a* extending in the width direction W, a second portion 21*b* extending downward from the first portion 21*a*, and a light interrupt portion 22 provided at an end portion of the first portion 21*a* in the width direction W. Similarly to the flag 12, the shutter 21 is in a locked state when the pickup roller 4 is located in the standby position, and is in an unlocked state when the pickup roller 4 is located in the feeding position.

Note that the conveyance unit 13 (see FIG. 3) is provided with a third sensor S3. The third sensor S3 includes a light-emitting unit S3*a* as a second light-emitting unit that emits light, and a light-receiving unit S3*b* as a second light-receiving unit capable of receiving the light emitted from the light-emitting unit S3*a*, and an optical path is formed between the light-emitting unit S3*a* and the light-receiving unit S3*b*. The light interrupt portion 22 of the shutter 21 is capable of interrupting the optical path of the third sensor S3. The third sensor S3 is in a light interrupting state in a condition where the optical path is interrupted by the light interrupt portion 22, and, according to the present embodiment, is turned OFF at this time. Further, the third sensor S3 enters a transmission state in a condition where the optical path is not interrupted by the light interrupt portion 22 and is open, and, according to the present embodiment, is turned ON at this time. That is, the third sensor S3 detects a document D based on the position of the shutter 21, which serves as a second moving member.

Sheet Feeding Control

Next, the sheet feeding control by the ADF 1C will be described by following the flowchart in FIG. 16. When the power of the image reading apparatus 103 is turned ON, the CPU 41 starts each processing of the sheet feeding control illustrated in FIG. 16. First, the CPU 41 determines whether the first sensor S1 and the third sensor S3 are turned ON (S21). In the present embodiment, as illustrated in FIG. 15, in a state where no document is loaded in the document tray 2, the first sensor S1 and the third sensor S3 are turned OFF. Note that the flag 12 and the shutter 21 are located in the standby positions illustrated in FIG. 15 under its own weight or due to a spring (not illustrated) in a natural state where no external force is applied.

When the user places document D in the document tray 2, the leading edge of document D abuts on a first portion 12*d*, a second portion 12*b*, and a third portion 12*c* of the flag 12 located in the standby position. As a result, the flag 12 is pushed by the leading edge of document D and is rotated to the abutment position as per the second embodiment. At this time, the light interrupt portion 15 of the flag 12 interrupts the optical path of the first sensor S1, and the first sensor S1 is turned ON.

Similarly, the first portion 21*a* and the second portion 21*b* of the shutter 21 are pushed by being pushed by the leading edge of document D, and are rotated to the abutment position similarly to the flag 12. At this time, the light interrupt portion 22 of the shutter 21 opens the optical path of the third sensor S3, and the third sensor S3 is turned ON.

In the present embodiment, the flag 12 and the shutter 21 are arranged on mutually opposing sides with the pickup roller 4 sandwiched therebetween in the width direction W. In other words, the flag 12 is arranged on one side of the pickup roller 4 in the width direction W, and the shutter 21 is arranged on the other side of the pickup roller 4 in the width direction W. Further, in the feeding direction FD, the positions of the first portion 12*d*, the second portion 12*b*, and the third portion 12*c* of the flag 12 located in the standby position are substantially the same as the positions of the first portion 21*a* and the second portion 21*b* of the shutter 21 located in the standby position. When both the first sensor S1 and the third sensor S3 are turned ON, the CPU 41 allows document feeding to start. On the other hand, in a case where the first sensor S1 and/or the third sensor S3 is not turned ON, the CPU 41 does not allow the start document feeding to start. That is, the CPU 41 is configured not to allow a sheet to be fed by the pickup roller 4 in a case where at least one of the first sensor S1 and the third sensor S3 does not detect a sheet. For example, even if the user places document D in the document tray 2 in a skewed state, document feeding is not allowed to start. As a result, the document can be prevented from being fed, and feed failures such as a jam can be reduced. That is, the first sensor S1 and the third sensor S3 have a function for detecting the presence or absence of a document D on the document tray 2.

Figure 16:
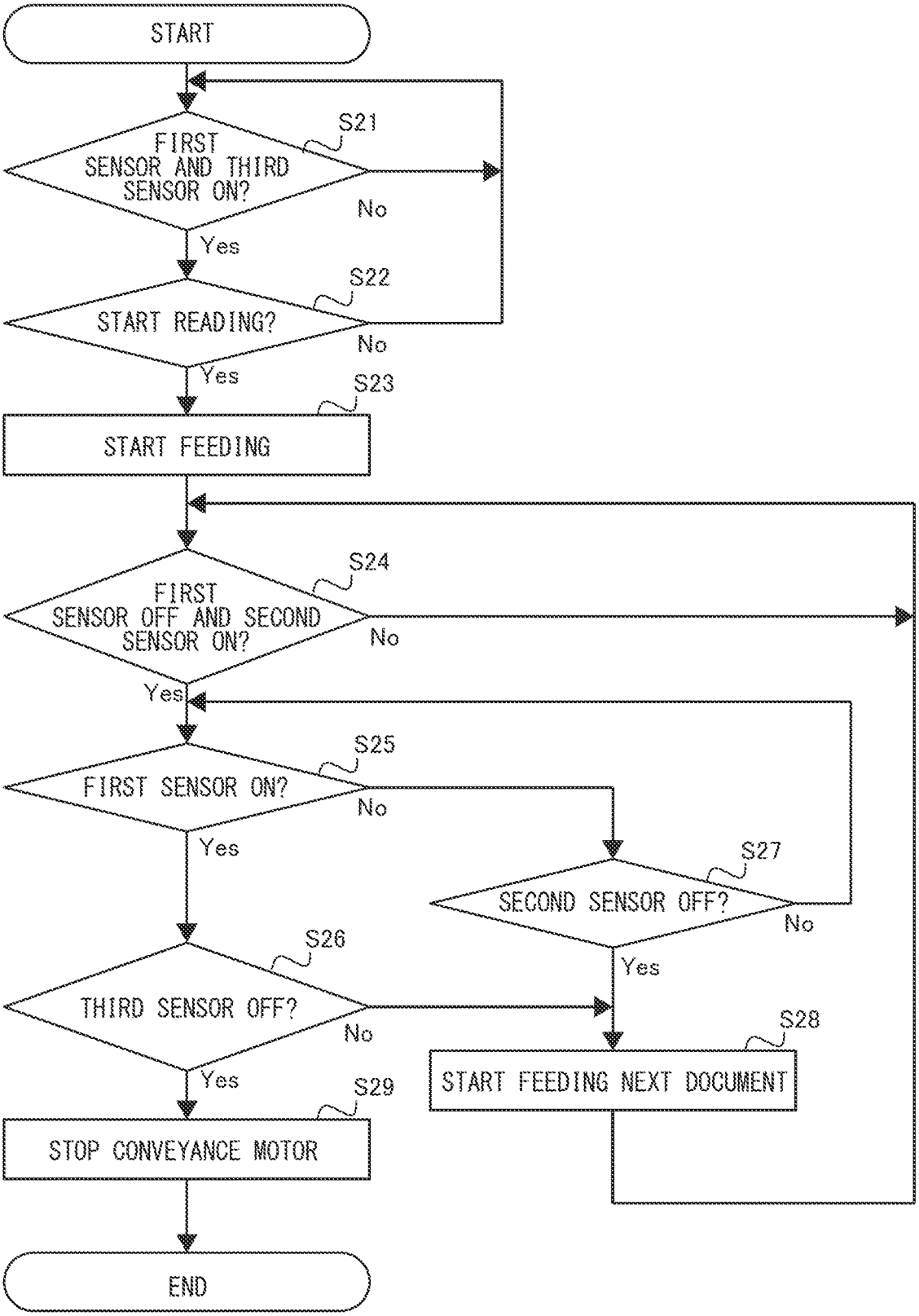
FIG. 16 is a flowchart illustrating feeding control.

As illustrated in FIG. 16, when document D is placed in the document tray 2 and the first sensor S1 and the third sensor S3 are turned ON (S21: Yes), the CPU 41 determines whether a reading start instruction has been inputted by the user via the operation unit 200, for example (S22). In a case where the first sensor S1 and the third sensor S3 are not turned ON in step S21 (S21: No) or in a case where a reading start instruction is not inputted in step S22 (S22: No), the CPU 41 returns to step S21.

In a case where it is determined that a reading start instruction has been inputted (S22: Yes), the CPU 41 drives the conveyance motor 42 to start feeding document D (S23). Note that the reading start instruction includes information such as size information of document D and the number of sheets to be fed. When the conveyance motor 42 is driven, the pickup arm 17 (see FIG. 15) descends, and the pickup roller 4 descends from the standby position to the feeding position. Further, the rollers, such as the pickup roller 4, the conveyance roller 5, and the separation roller 6, are driven. When the pickup roller 4 moves from the standby position to the feeding position, the flag 12 and the shutter 21 are switched from the locked state to the unlocked state.

Next, the CPU 41 determines whether the first sensor S1 is OFF and the second sensor S2 is ON (S24). As illustrated in FIG. 13, which is used in the second embodiment, when document D1 is being fed by the pickup roller 4, the flag 12 and the shutter 21 rotate in direction R1 about the rotation shaft 16 as a result of being pushed by the leading edge of document D1. Thus, the first sensor S1 and the third sensor S3 are switched to OFF. Further, while a fed document D2 is passing through the detection position of the second sensor S2, the second sensor S2 is turned ON.

In this manner, in a case where the first sensor S1 is turned OFF and the second sensor S2 is turned ON in the state illustrated in FIG. 13 (S24: Yes), the CPU 41 determines whether the first sensor S1 is turned ON (S25).

In step S25, the case where the first sensor S1 is turned ON is a case where document D2, which succeeds document D1 and is not being multi-fed, is loaded in the document tray 2 as illustrated in FIG. 14B, or a case where there is no succeeding document in the document tray 2. In a case where the first sensor S1 is turned ON (S25: Yes), the CPU 41 determines whether the third sensor S3 is turned OFF (S26).

Note that, as illustrated in FIG. 14B, in a state in which the flag 12 abuts on the leading edge of document D2 which is not being multi-fed, the shutter 21 abuts on the leading edge of document D2, and is thus slightly rotated from the standby state. Therefore, at this time, the third sensor S3 is turned ON. On the other hand, when there is no succeeding document in the document tray 2, the shutter 21 returns to the standby position, and hence the third sensor S3 is turned OFF. That is, when the third sensor S3 is turned ON, it is clear that there is a succeeding document in the document tray 2, and when the third sensor S3 is turned OFF, it is clear that there is no succeeding document in the document tray 2. In this manner, it is possible to determine the presence or absence of a document on the document tray 2 by checking for a signal of the third sensor S3.

In a case where the third sensor S3 is not turned OFF (S26: No), because document D2, which is not being multi-fed, is in the document tray 2, the CPU 41 starts feeding the next document (D2) (S28). After the next document is fed, the CPU 41 returns to the processing of step S24.

Furthermore, in a case where the third sensor SS is turned OFF (S26: Yes), because there is no document in the document tray 2, the CPU 41 stops the conveyance motor 42 (S29), and ends the sheet feeding control.

As described above, in a case where document D2 is multi-fed with the preceding document D1 and the first sensor S1 is not turned ON in S25 (S25: No), the CPU 41 determines whether the second sensor S2 is turned OFF (S27). In a case where the second sensor S2 is not turned OFF (S27: No), document D1 is still passing through the second sensor S2, and the CPU 41 returns to step S25.

In a case where the second sensor S2 is turned OFF (S27: Yes), the CPU 41 determines that the trailing edge of document D1 has passed through the detection position of the second sensor S2, and starts feeding the succeeding document D2 (S28). After the document is fed, the CPU 41 returns to the processing of step S24.

As described above, in the present embodiment, it is possible to change the feeding timing of the document D2 which has been multi-fed (see FIG. 14A) and the document D2 which is not being multi-fed (see FIG. 14B). Further, in the present embodiment, the presence or absence of a document on the document tray 2 can be detected by determining, in step S26, whether the third sensor S3 is turned OFF, before the flag 12 returns to the standby position. Therefore, the first feeding timing can be accelerated relative to those of the first and second embodiments, and thus productivity can be further improved.

More specifically, the third sensor S3 outputs an ON signal as a fifth signal in a state where the shutter 21 is in contact with the leading edge of document D2 which is not being multi-fed. In addition, the third sensor S3 outputs an OFF signal as a sixth signal different from the fifth signal in a state where the shutter 21 is not in contact with document D1 and document D2.

The CPU 41 allows the pickup roller 4 to feed the document in a state in which the first sensor S1 outputs an ON signal and the third sensor S3 outputs an ON signal. Further, in a case where document D2 is not being multi-fed (S25: Yes), the pickup roller 4 feeds document D2 at first feeding timing. In other words, in a case where the first sensor S1 outputs an ON signal and the third sensor S3 outputs an ON signal after document D1 is fed and the second sensor S2 outputs an ON signal, the CPU 41 feeds document D2 at the first feeding timing. Further, in a case where the first sensor S1 outputs an ON signal and the third sensor S3 outputs an OFF signal after document D1 is fed and the second sensor S2 outputs an ON signal, the CPU 41 stops the pickup roller 4.

Further, in a case where document D2 is being multi-fed (S25: No), the pickup roller 4 feeds document D2 at second timing, which lags the first feeding timing. In other words, in a case where the first sensor S1 outputs the OFF signal and the second sensor S2 outputs the OFF signal after document D1 is fed and the second sensor S2 outputs the ON signal, the CPU 41 feeds document D2 at the second feeding timing.

As described above, in the present embodiment, the presence or absence of the documents loaded in the document tray 2 is detected based on the detection results of the first sensor S1 and the third sensor S3. Further, in the present embodiment, the feeding timing at which the pickup roller 4 starts feeding a document is controlled based on the detection results of the first sensor S1, the second sensor S2, and the third sensor S3. That is, the document feeding timing is changed according to the position of the leading edge of the document loaded in the document tray 2.

More specifically, in a case where the leading edge of document D2, which succeeds document D1, is located at the first position illustrated in FIG. 14B, the CPU 41 feeds document D2 at the first feeding timing. Furthermore, in a case where the leading edge of document D2 is located at a second position downstream of the first position with respect to the feeding direction FD illustrated in FIG. 14A, the CPU 41 feeds document D2 at the second feeding timing. For this reason, because the document feeding timing is changed according to the position of the leading edge of the document loaded in the document tray 2, variation in the sheet interval can be suppressed and the sheet interval can be shortened, thus improving productivity. Further, because the first sensor S1 and the third sensor S3 have a function for detecting the presence or absence of a document on the document tray 2 and a function for detecting the document feeding timing, the number of sensors can be reduced in comparison with a case where such functions are realized by providing separate sensors. Therefore, space can be saved, enabling a more compact and lower-cost apparatus.

In addition, the first sensor S1 and the third sensor S3 are arranged on mutually opposing sides with the pickup roller 4 sandwiched therebetween in the width direction W. Further, because the presence or absence of a document on the document tray 2 is detected by the first sensor S1 and the third sensor S3, even if the user places the document in a skewed state in the document tray 2, it is possible to prevent document feeding from being allowed. Therefore, conveyance failures can be reduced.

In a case where it is detected in step S21 of FIG. 16 that only either one of the first sensor S1 and the third sensor S3 is turned ON, the CPU 41 may display, on the operation unit 200, a message prompting that the document be placed once again.

As described in each of the foregoing embodiments, according to the present invention, it is possible to provide a more compact and lower-cost apparatus while improving productivity.

OTHER EMBODIMENTS

In all of the foregoing embodiments, a document is fed by the pickup roller 4, but the present invention is not limited to such a configuration. For example, instead of the pickup roller 4, a document may be fed by a sheet feeding belt or the like.

In the third embodiment, in addition to the flag 12 and the shutter 21, a document stopper 14 may be provided as per the first embodiment.

In all of the foregoing embodiments, the sheet feeding control of the ADFs 1, 1B, and 1C, which constitute sheet feeding apparatuses, was described, but the invention is not limited to such control. For example, the above-described feed control and configuration of the flag, the shutter, and each sensor may be applied to the sheet feeding unit 34 of the printer body 101A.

In all of the foregoing embodiments, the ON state or the OFF state of the first sensor S1, the second sensor S2, and the third sensor S3 may each be reversed. There are no limitations on the shapes and materials of the flag 12 and the shutter 21 for turning on or off the first sensor S1 and the third sensor S3. Further, the second sensor S2 may be configured to switch ON/OFF according to a flag, and the first sensor S1 and the second sensor S2 may be optical sensors not including a flag. In addition, the first sensor S1, the second sensor S2, and the third sensor S3 are not limited to being optical sensors, and for example, an ultrasonic sensor or a magnetic sensor may be applied.

In all of the foregoing embodiments, the image reading apparatus 103, which includes the ADFs 1, 1B, and 1C, and the image forming apparatus 101 can be regarded as sheet feeding apparatuses. In addition, the control unit 132 provided to the image forming apparatus 101 may execute the above-described sheet feeding control of the ADFs 1, 1B, and 1C. Further, a CPU may be provided to the ADFs 1, 1B, and 1C, and the sheet feeding control of the ADFs 1, 1B, and 1C described above may be executed by the CPU.

In all of the foregoing embodiments, the electrophotographic-type image forming apparatus 101 was described, but the present invention is not limited thereto. For example, the present invention can also be applied to an inkjet-type image forming apparatus or an offset printing-type image forming apparatus that forms an image on a sheet by ejecting ink fluid from nozzles.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-091741, filed Jun. 6, 2022 which is hereby incorporated by reference herein in its entirety.

What is claimed is:

1. A sheet feeding apparatus comprising:

a supporting unit configured to support a sheet;

a sheet feeding unit configured to feed the sheet supported by the supporting unit in a feeding direction;

a separation unit configured to separate sheets fed by the sheet feeding unit one by one;

a first moving member disposed on one side of the sheet feeding unit in a width direction orthogonal to the feeding direction and configured to move by being pushed by the sheet supported by the supporting unit;

a second moving member disposed on the other side of the sheet feeding unit in the width direction and configured to move by being pushed by the sheet supported in the supporting unit;

a first sensor configured to detect the sheet based on a position of the first moving member;

a second sensor configured to detect the sheet at a position downstream of the separation unit in the feeding direction;

a third sensor configured to detect the sheet based on the position of the second moving member; and a control unit configured to determine whether or not to allow the sheet to be fed by the sheet feeding unit based on the first sensor and the third sensor, and to control feeding timing at which the sheet feeding unit starts to feed the sheet based on detection results of the first sensor and the second sensor, wherein the control unit is configured to allow the sheet to be fed by the sheet feeding unit in a case where both the first sensor and the third sensor detect the sheet, and not allow the sheet to be fed by the sheet feeding unit in a case where at least one of the first sensor or the third sensor does not detect the sheet.

2. The sheet feeding apparatus according to claim 1, wherein;

in a case where a first sheet and a second sheet succeeding the first sheet are supported by the supporting unit and a leading edge of the second sheet is located at a first position after the first sheet is fed, the control unit is configured to feed the second sheet at first feeding timing, and in a case where the leading edge of the second sheet is located at a second position downstream of the first position with respect to the feeding direction after the first sheet is fed, the control unit is configured to feed the second sheet at second feeding timing delayed from the first feeding timing.

3. The sheet feeding apparatus according to claim 2, wherein:

the first sensor is configured to output a first signal in a state where the first moving member is in contact with the leading edge of the second sheet located at the first position, the first sensor is configured to output a second signal which differs from the first signal in a state where the first moving member is in contact with the leading edge of the second sheet located at the second position, in a state where the first moving member is in contact with a surface of the first sheet fed by the sheet feeding unit after a leading edge of the first sheet pass through the first moving member, and in a state where the first moving member is not in contact with the first sheet and the second sheet, the second sensor is configured to output a third signal in a case where the first sheet is positioned at a predetermined detection position, and to output a fourth signal which is different from the third signal in a case where the first sheet is not positioned at the detection position, and the control unit is configured to control the sheet feeding unit to feed the second sheet at the first feeding timing in a case where the first sensor outputs the first signal after the first sheet is fed and the second sensor outputs the third signal, and where the first sensor does not output the second signal within a predetermined time after the first sensor outputs the first signal.

4. The sheet feeding apparatus according to claim 3, wherein the control unit is configured to control the sheet feeding unit to feed the second sheet at the second feeding timing in a case where the first sensor outputs the second signal after the first sheet is fed and the second sensor outputs the third signal, and where the second sensor outputs the fourth signal.

5. The sheet feeding apparatus according to claim 4, wherein the control unit is configured to stop the sheet feeding unit in a case where the first sensor outputs the first signal after the first sheet is fed and the second sensor outputs the third signal, and where the first sensor outputs the second signal within the predetermined time after the first sensor outputs the first signal.

6. The sheet feeding apparatus according to claim 3, wherein:

the first sensor includes a light-emitting unit that emits light and a light-receiving unit that receives the light emitted from the light-emitting unit, the first sensor is configured to output the first signal in a case where the light emitted from the light-emitting unit is interrupted by the first moving member, and the first sensor is configured to output the second signal in a case where the light emitted from the light-emitting unit is not interrupted by the first moving member and is received by the light-receiving unit.

7. The sheet feeding apparatus according to claim 2, further comprising:

an abutment member including an abutment portion against which the leading edge of the second sheet is abutted, and configured to move between an abutment position and a moving position by being pushed by the first sheet or the second sheet, wherein the abutment portion is configured to position the leading edge of the second sheet in the first position in a case where the abutment member is positioned at the abutment position.

8. The sheet feeding apparatus according to claim 7, further comprising:

a first regulating unit, wherein the sheet feeding unit is configured to move to a standby position spaced apart from the sheet supported by the supporting unit, and to a feeding position in which the sheet feeding unit is in contact with the sheet supported by the supporting unit, and wherein the first regulating unit is configured to regulate the abutment member to move from the abutment position in a case where the sheet feeding unit is located in the standby position, and to allow the abutment member to move from the abutment position in a case where the sheet feeding unit is located in the feeding position.

9. The sheet feeding apparatus according to claim 2, wherein:

the first moving member includes an abutment portion configured to be abutted by the leading edge of the second sheet, and is configured to move between an abutment position and a moving position by being pushed by the first sheet or the second sheet, and the abutment portion is configured to position the leading edge of the second sheet in the first position in a case where the first moving member is positioned at the abutment position.

10. The sheet feeding apparatus according to claim 9, further comprising:

a second regulating unit, wherein the sheet feeding unit is configured to move to a standby position spaced apart from the sheet supported by the supporting unit, and to a feeding position in which the sheet feeding unit is in contact with the sheet supported by the supporting unit, and wherein the second regulating unit is configured to regulate the first moving member to move from the abutment position in a case where the sheet feeding unit is located in the standby position, and to allow the first moving member to move from the abutment position in a case where the sheet feeding unit is located in the feeding position.

11. The sheet feeding apparatus according to claim 1, further comprising:

a body unit configured to support the first sensor and the second sensor; and a cover supported by the body unit and configured to open/close the body unit, wherein the sheet feeding unit and the first and second moving members are movably supported by the cover.

12. The sheet feeding apparatus according to claim 1, further comprising a reading unit configured to read an image of the sheet fed by the sheet feeding apparatus.

13. The sheet feeding apparatus according to claim 12, further comprising an image forming unit configured to form an image on the sheet.

14. The sheet feeding apparatus according to claim 1, wherein:

the sheet feeding unit is configured to move to a standby position spaced apart from the sheet supported by the supporting unit, and to a feeding position in which the sheet feeding unit is in contact with the sheet supported by the supporting unit, and the first and second moving members are configured to be in:

a locked state in which movement of the sheet in the feeding direction is regulated in a case where the sheet feeding unit is located in the standby position; and an unlocked state in which movement of the sheet in the feeding direction is allowed in a case where the sheet feeding unit is located in the feeding position.

* * * * *